US009375935B2

(12) United States Patent
Harada et al.

(10) Patent No.: US 9,375,935 B2
(45) Date of Patent: Jun. 28, 2016

(54) WASTE LIQUID CONTAINER, LIQUID EJECTION DEVICE, AND WASTE LIQUID COLLECTION SYSTEM

(71) Applicant: SEIKO EPSON CORPORATION, Tokyo (JP)

(72) Inventors: Shuhei Harada, Chino (JP); Masanori Nakata, Matsumoto (JP); Shigenori Fukasawa, Shiojiri (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/957,202

(22) Filed: Dec. 2, 2015

(65) Prior Publication Data

US 2016/0114589 A1 Apr. 28, 2016

Related U.S. Application Data

(63) Continuation of application No. 14/735,728, filed on Jun. 10, 2015, now Pat. No. 9,227,407.

(30) Foreign Application Priority Data

Jun. 27, 2014 (JP) ..... 2014-133197

(51) Int. Cl.
*B41J 2/165* (2006.01)
*B41J 2/17* (2006.01)

(52) U.S. Cl.
CPC ..... *B41J 2/1721* (2013.01); *B41J 2/16517* (2013.01); *B41J 2/16523* (2013.01)

(58) Field of Classification Search
CPC ..... B41J 2/16517; B41J 2/16523; B41J 2002/1728; B41J 2002/1721; B41J 2002/1735; B41J 2002/1742
See application file for complete search history.

(56) References Cited

U.S. PATENT DOCUMENTS 7,571,981 B2 * 8/2009 Yamada ..... B41J 2/16523 347/36
7,905,571 B2 * 3/2011 Byun ..... B41J 2/1721 347/20
7,976,121 B2 * 7/2011 Harada ..... B41J 2/16523 347/31
2005/0248637 A1 11/2005 Seino et al.
2008/0136878 A1 6/2008 Nozawa et al.

(Continued)

FOREIGN PATENT DOCUMENTS

JP 2009-269200 11/2009
JP 2009-269205 11/2009

(Continued)

*Primary Examiner* — Juanita D Jackson
(74) *Attorney, Agent, or Firm* — Workman Nydegger

(57) ABSTRACT

A waste liquid container includes a fitted portion, in which a discharge unit is fittable in a removable manner, a container connection terminal, which contacts a device connection terminal, an insertion restriction portion, which contacts a device contact portion and restricts movement of the waste liquid container in the insertion direction, and an engaged portion, which includes a contacted portion that contacts a removal restriction unit and restricts movement of the waste liquid container in the removal direction. The engaged portion is located toward an inner side in the lateral direction from a side wall at a position lower than both of the container connection terminal and the insertion restriction portion. The removal restriction unit is receivable in a region located toward an outer side in the lateral direction from the engaged portion.

7 Claims, 16 Drawing Sheets

(56) References Cited

U.S. PATENT DOCUMENTS

| | | | |
|---|---|---|---|
| 2009/0219338 | A1 | 9/2009 | Harada |
| 2009/0219339 | A1 | 9/2009 | Harada |
| 2009/0251512 | A1 | 10/2009 | Nozawa et al. |
| 2012/0236074 | A1 | 9/2012 | Harada et al. |

FOREIGN PATENT DOCUMENTS

| | | |
|---|---|---|
| JP | 2010-012803 | 1/2010 |
| JP | 2010-149522 | 7/2010 |
| JP | 2012-196804 | 10/2012 |
| WO | WO2008/056487 | 5/2008 |

* cited by examiner

WASTE LIQUID CONTAINER, LIQUID EJECTION DEVICE, AND WASTE LIQUID COLLECTION SYSTEM

CROSS REFERENCES TO RELATED APPLICATIONS

This application is a Continuation of U.S. application Ser. No. 14/735,728 filed Jun. 10, 2015, now issued U.S. Pat. No. 9,227,407, which is expressly incorporated herein by reference. The entire disclosure of Japanese Patent Application No. 2014-133197, filed Jun. 27, 2014, is expressly incorporated by reference herein.

BACKGROUND

1. Technical Field

The present invention relates to a waste liquid container, which contains waste liquid such as waste ink that has been used in a device, and a liquid ejection device, into which the waste liquid container is fitted and retained in a retaining compartment in a removable manner. Further, the present invention relates to a waste liquid collection system provided with a waste liquid container retaining unit, which includes a retaining compartment, and a waste liquid container, which is fitted into and retained in a removable manner in the retaining compartment.

2. Related Art

JP-A-2012-196804 describes an example of a container serving as a waste liquid container that may be retained in a liquid ejection device. The liquid ejection device, in which such a waste liquid container is retained, includes a retaining compartment that is in communication with the outside through an opening. The waste liquid container is inserted through the opening toward the innermost part of the retaining compartment. When the waste liquid container is in a retained state retained in the liquid ejection device, a discharge unit located at the innermost part of the retaining compartment is fitted into an fitted portion in the front wall of the waste liquid container. This allows the waste liquid that has been used by the liquid ejection device to be discharged through the discharge unit into a collection compartment formed in the waste liquid container.

The waste liquid container includes first and second side walls connected to a front wall and located on opposite sides of the collection compartment. The first side wall includes an outwardly projecting positioning projection. The retaining compartment of the liquid ejection device includes a plate spring that biases the positioning projection of the first wall when the waste liquid container is in the retained state. When the positioning projection receives the biasing force of the plate spring, the waste liquid container is biased in the direction from the first side wall to the second side wall.

The second side wall includes a container connection terminal that contacts a device connection terminal, which is located in the retaining compartment. When the waste liquid container is in the retained state, the biasing force of the plate spring pushes the container connection terminal against the device connection terminal. This keeps the connection terminals held in contact with each other in a satisfactory manner. When the connection terminals are connected in such a manner, a controller of the liquid ejection device is able to read or rewrite the contents stored in a memory such as an IC chip of the waste liquid container.

As described above, the first side wall of the waste liquid container includes the outwardly projecting positioning projection. Thus, the retaining compartment of the liquid ejection device needs to be provided with space that allows for movement of the positioning projection when the waste liquid container is inserted into the retaining compartment and when the waste liquid container is removed from the retaining compartment. Such space forms dead space.

In the retaining compartment, the waste liquid container in the retained state may be forced against the lower surface of the retaining compartment to stably position the waste liquid container. However, when the waste liquid container described in JP-A-2012-196804 is in the retained state, the biasing force of the plate spring acts in the horizontal direction. Thus, the waste liquid container is not pressed against the lower surface, and the positioning of the waste liquid container in the retaining compartment may become unstable.

Such a problem is not limited to when retaining a waste liquid container in a liquid ejection device and may also occur when retaining a waste liquid container in a device other than a liquid ejection device.

SUMMARY

An advantage of some aspects of the invention is to provide a waste liquid container, a liquid ejection device, and a waste liquid collection system that stably position the waste liquid container in the retaining compartment when the waste liquid container is in a retained state inserted in the retaining compartment, while reducing the space used by the retaining compartment.

One aspect of the invention is a waste liquid container that is coupled in a removable manner to a device that includes a retaining compartment and a discharge unit, which is located at an innermost part of the retaining compartment. The waste liquid container is adapted to be inserted into the retaining compartment in a direction defined as an insertion direction. The waste liquid container is adapted to be removed from the retaining compartment in a direction that is opposite to the insertion direction and defined as a removal direction, and the insertion direction and a vertical direction both are transverse to a direction defined as a lateral direction. The waste liquid container includes a collection compartment located inside the waste liquid container. The discharge unit discharges waste liquid into the collection compartment when the waste liquid container is in a retained state inserted into the retaining compartment. A front wall is located at an innermost part of the retaining compartment in the retained state. A fitted portion is located in the front wall. The discharge unit is fittable to and removable from the fitted portion. A side wall extends in the removal direction from the front wall in the retained state. A container connection terminal is located in the side wall at a position lower than the fitted portion. The container connection terminal is contactable with a connection terminal of the device. An insertion restriction portion is configured to restrict movement of the waste liquid container in the insertion direction when contacting a contact portion of the device in the retained state. An engaged portion includes a contacted portion configured to restrict movement of the waste liquid container in the removal direction when contacting a removal restriction unit of the device in the retained state. The engaged portion is located toward an inner side in the lateral direction from the side wall at a position lower than both of the container connection terminal and the insertion restriction portion in the retained state. The removal restriction unit is receivable in a region located toward an outer side in the lateral direction from the engaged portion when in the retained state.

Another aspect of the invention is a liquid ejection device including the waste liquid container described above, a liquid ejection head that ejects liquid, a retaining compartment into which the waste liquid container is inserted so that the waste liquid container is retained in a removable manner, and a discharge unit that discharges waste liquid into the collection compartment of the waste liquid container that is inserted into the retaining compartment.

A further aspect of the invention is a waste liquid collection system provided with a waste liquid container retaining unit, which includes a retaining compartment, and a waste liquid container adapted to be inserted into and retained in the retaining compartment in a removable manner. The waste liquid container is adapted to be inserted into the retaining compartment in a direction defined as an insertion direction, the waste liquid container is removed from the retaining compartment in a direction that is opposite to the insertion direction and defined as a removal direction, and the insertion direction and a vertical direction both are transverse to a direction defined as a lateral direction. The waste liquid container retaining unit includes a discharge unit that discharged waste liquid. The discharge unit is located at an innermost part of the retaining compartment. A device discharge unit member biases the discharge unit in the removal direction. A device connection terminal is located at a position lower than the discharge unit. A device contact portion is configured to restrict movement of the waste liquid container in the insertion direction by contacting a portion of the waste liquid container when the waste liquid container is in a retained state inserted into the retaining compartment. A removal restriction unit is configured to restrict movement of the waste liquid container in the removal direction when in the retained state. The removal restriction unit is located at a position lower than the device connection terminal. The waste liquid container includes a front wall located at an innermost part of the retaining compartment in the retained state. A fitted portion is located in the front wall. The discharge unit is fitted into the fitted portion. A side wall extends in the removal direction from the front wall in the retained state. A container connection terminal contacts the device connection terminal. The container connection terminal is located in the side wall at a position lower than the fitted portion. An insertion restriction portion contacts the device contact portion in the retained state. An engaged portion includes a contacted portion that contacts the removal restriction unit in the retained state. The engaged portion is located at a position lower than both of the container connection terminal and the insertion restriction portion in the retained state. The engaged portion is located toward an inner side in the lateral direction from the side wall, and the removal restriction unit is receivable in a region located toward an outer side in the lateral direction from the engaged portion when in the retained state.

Other aspects and advantages of the present invention will become apparent from the following description, taken in conjunction with the accompanying drawings, illustrating by way of example the principles of the invention.

BRIEF DESCRIPTION OF THE DRAWINGS

The invention will be described with references to the accompanying drawings, wherein like numbers reference like elements.

DESCRIPTION OF EXEMPLARY EMBODIMENTS

One embodiment of a waste liquid container and a liquid ejection device will now be described with reference to FIGS. 1 to 17.

Figure 1:
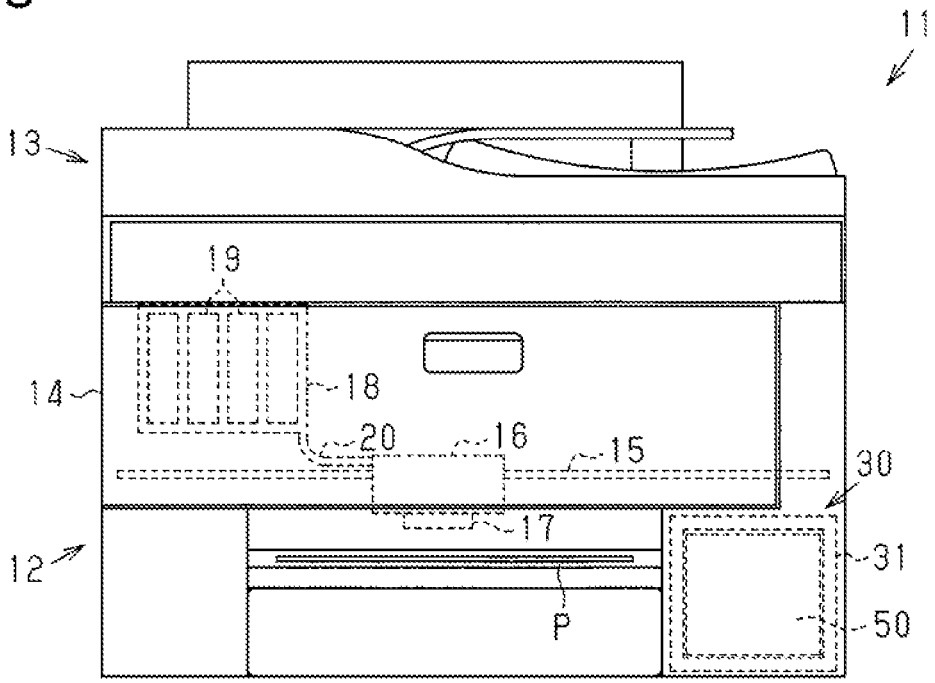
FIG. 1 is a front view showing an all-in-one printer including a recording unit that is one embodiment of a liquid ejection device.

As shown in FIG. 1, an all-in-one printer 11 includes a recording unit 12, which is one example of a liquid ejection device, and an image reading unit 13, which reads images from a medium. The recording unit 12 and the image reading unit 13 are arranged one upon the other in the vertical direction.

The recording unit 12 is an inkjet printer and includes a recording unit case 14, which forms a housing of a liquid ejection device. The recording unit case 14 accommodates a guide 15, which extends in a main scanning direction (sideward direction as viewed in FIG. 1), and a carriage 16, which is supported by the guide 15 and movable in the main scanning direction. When driven by a carriage motor (not shown), the carriage 16 reciprocates in the main scanning direction. A recording head 17, which is one example of a liquid ejection head, is arranged on the carriage 16. The recording head 17 includes nozzles that eject ink, which is one example of a liquid. Ink is ejected from the recording head 17 while the carriage 16 moves in the scanning direction to print records on paper P, which is one example of a target.

A cartridge holder 18 is arranged in the recording unit case 14 at the left side as viewed in FIG. 1. The cartridge holder 18 holds a plurality of (four in FIG. 1) removable ink cartridges 19, which contain ink. Ink is supplied from the ink cartridges 19, which are held in the cartridge holder 18, to the recording head 17 through an ink supplying tube 20.

A maintenance device 30 is arranged in the recording unit case 14 at the right side as viewed in FIG. 1 to perform maintenance on the ink supplying system, which includes the recording head 17. The maintenance device 30 includes a waste liquid container retaining unit 31, which retains a waste liquid container 50 in a removable manner. When the maintenance device 30 performs maintenance (e.g., suction cleaning), the recording head 17 discharges ink as waste ink, which is discharged into the waste liquid container 50. In this manner, the container retaining unit 31 and the waste liquid container 50 forms an example of a "waste liquid collection system" that collects waste liquid, which has been used by the recording unit 12.

Figure 2:
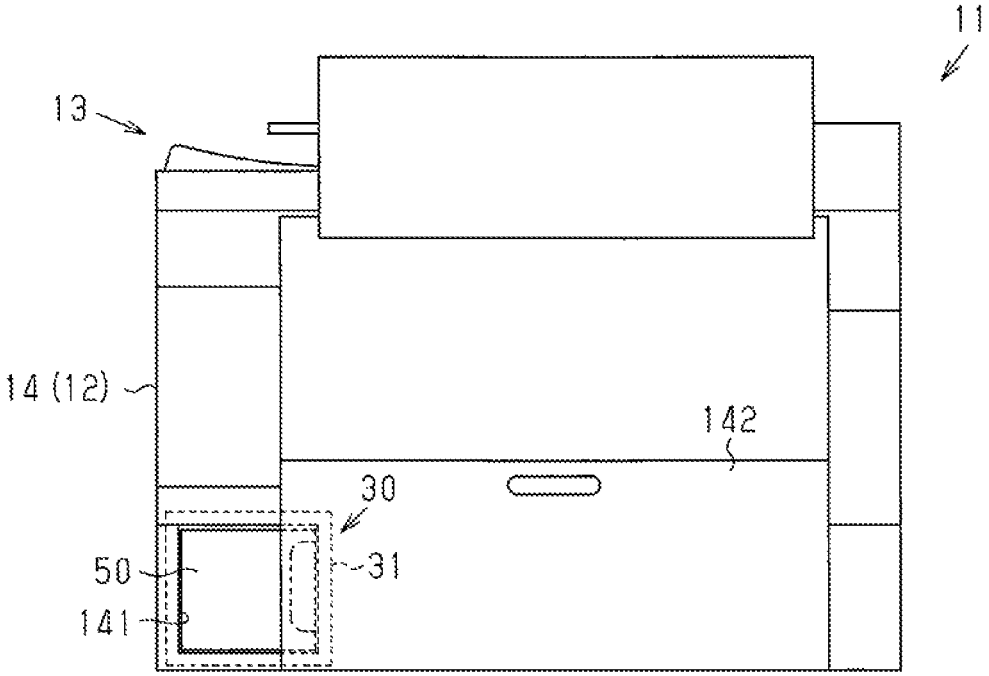
FIG. 2 is a rear view showing the all-in-one printer of FIG. 1.

As shown in FIG. 2, a retaining port 141 is arranged at the left lower portion as viewed in FIG. 2 in the rear surface of the recording unit case 14. The inside of the waste liquid container retaining unit 31 is in communication with the outside through the retaining port 141. The waste liquid container 50 is inserted into or removed from the container retaining unit 31 through the retaining port 141. "A retained state" may refer to a state when the waste liquid container 50 is retained to the container retaining unit 31.

A rear cover 142, which can be opened and closed, is coupled at the lower portion as viewed in FIG. 2 in the rear surface of the recording unit case 14. When the rear cover 142 is open, the waste liquid container 50 may be attached to or removed from the container retaining unit 31.

The structure of the container retaining unit 31 will now be described with reference to FIGS. 3 and 4. In this specification, the waste liquid container 50 is attached to and removed from the waste liquid container retaining unit 31 in a direction referred to as "the connection-disconnection direction X." In particular, the waste liquid container 50 for attachment to the waste liquid container retaining unit 31 is referred to as "the insertion direction X1." The opposite direction to the insertion direction X1 and the waste liquid container 50 for removal from the waste liquid container retaining unit 31 is referred to as "the removal direction X2." The direction perpendicular to the plane on which the all-in-one printer 11 is arranged is referred to "the vertical direction Y," and the direction perpendicular to (intersecting) the connection-disconnection direction X and the vertical direction Y is referred to as "the lateral direction Z."

Figure 3:
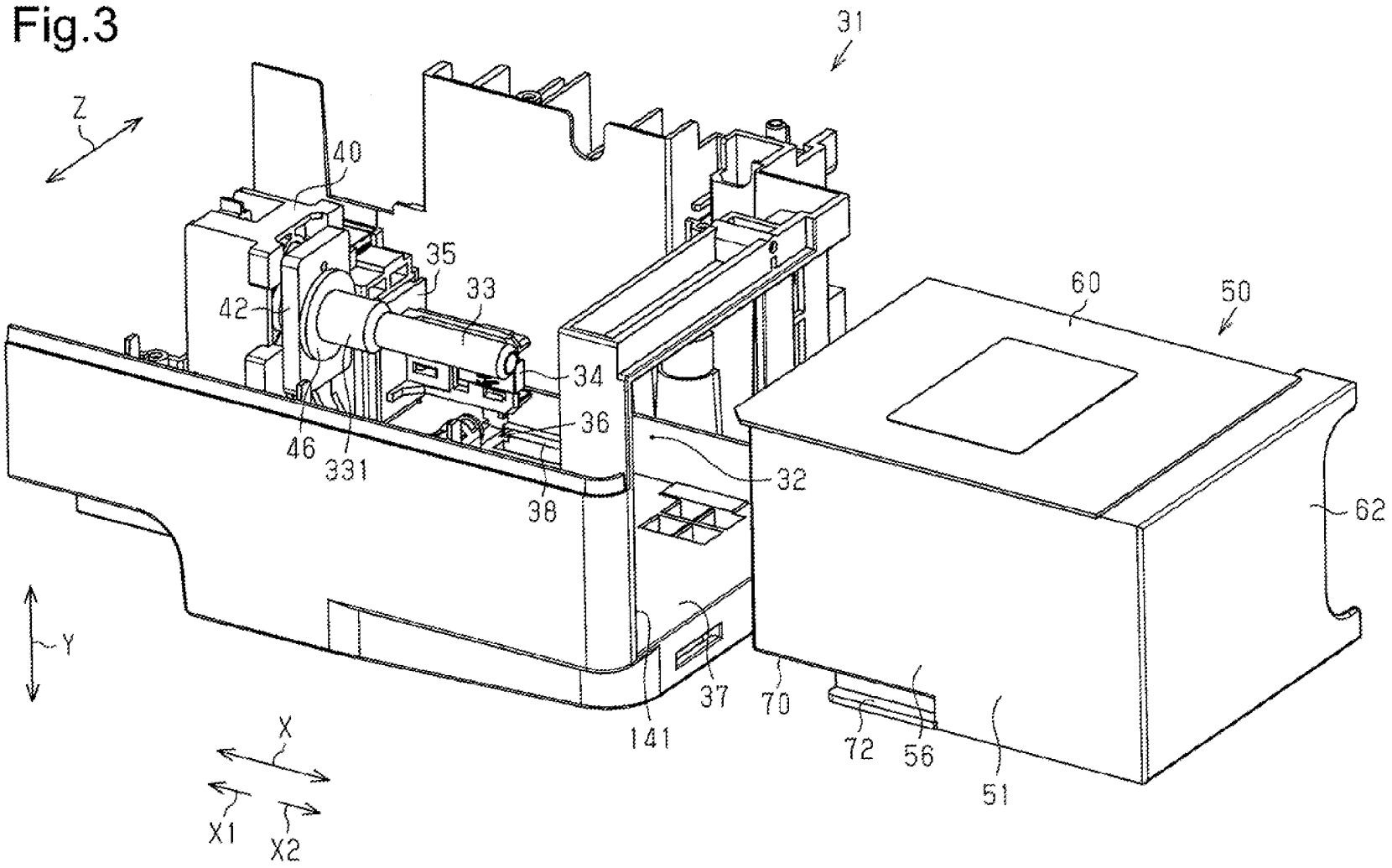
FIG. 3 is a perspective view of a waste liquid container shown in FIG. 1 and a container retaining unit in which the waste liquid container is retained.

As shown in FIG. 3, the waste liquid container retaining unit 31 includes a retaining compartment 32, which is in communication with the outside through the retaining port 141. The waste liquid container 50 is inserted into the retaining compartment 32 through the retaining port 141 and removed from the retaining compartment 32 through the retaining port 141. The innermost part of the retaining compartment 32 includes a discharge unit 33, which discharges waste liquid discharged from the recording head 17, and a device connection terminal 34, which is electrically connected to a controller of the all-in-one printer 11.

Figure 4A:
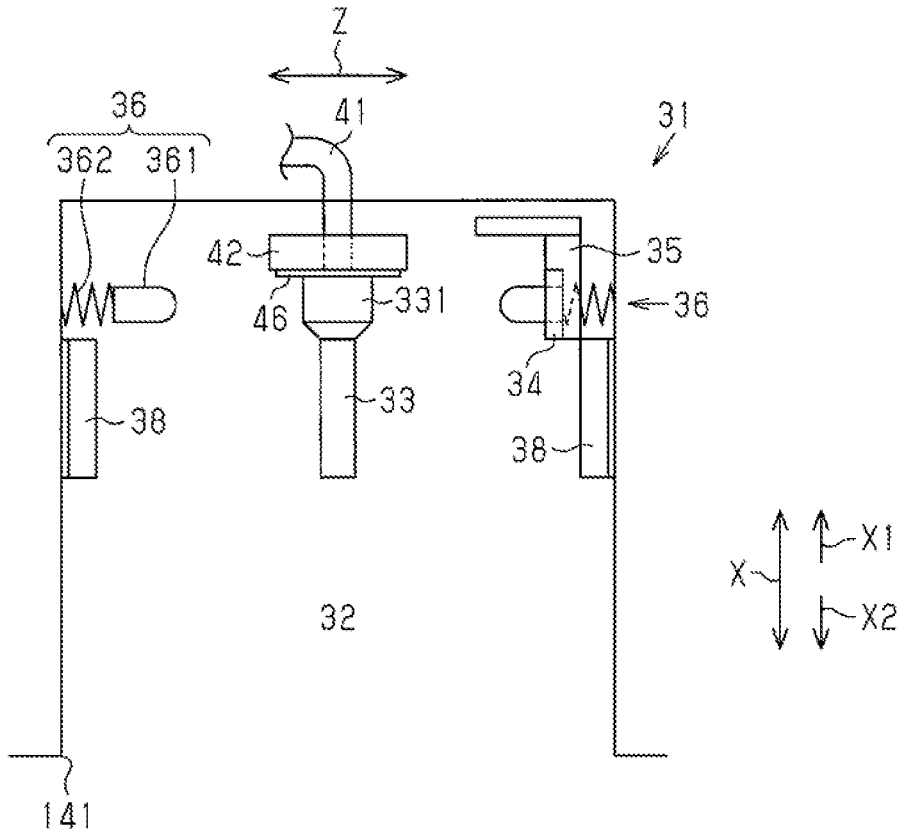
FIG. 4A is a schematic diagram showing the internal structure of the container retaining unit of FIG. 3.
Figure 4B:
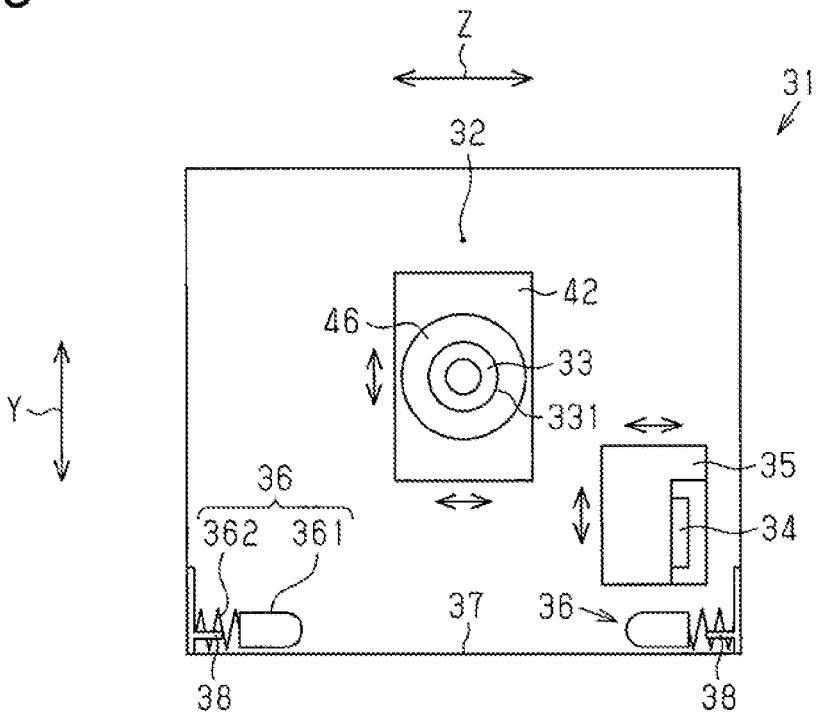
FIG. 4B is a schematic diagram showing the internal structure of the container retaining unit of FIG. 3.

As shown in FIGS. 3, 4A, and 4B, the discharge unit 33 is located at the middle of the innermost part of the retaining compartment 32 in the lateral direction Z. In the innermost part of the retaining compartment 32, the discharge unit 33 is slightly movable in the lateral direction Z and the vertical direction Y. A structure that supports the discharge unit 33 in the retaining compartment 32 will be described later.

The device connection terminal 34 is located at a position separated toward one side in the lateral direction Z (toward the right in FIG. 4) from the discharge unit 33 and located at a position that is lower than the discharge unit 33. A terminal support 35, which supports the device connection terminal 34, is slightly movable in the lateral direction Z and the vertical direction Y. Thus, the device connection terminal 34 is slightly movable in the lateral direction Z and the vertical direction Y independently from the discharge unit 33.

A removal restriction unit 36 is located in the innermost part of the retaining compartment 32 at a position lower than the device connection terminal 34. The removal restriction unit 36 restricts movement of the waste liquid container 50 in the removal direction X2 when the waste liquid container 50 is in the retained state. In the recording unit 12 of the present embodiment, a removal restriction unit 36 is arranged at each of the two sides of the sides of the retaining compartment 32 in the lateral direction Z. The two removal restriction units 36 each include a restriction member 361 and a restriction biasing member 362. The restriction member 361 is movable forward and backward in the lateral direction Z. The restriction biasing member 362 applies biasing force to the restriction member 361 acting toward the inner side in the lateral direction Z. Each restriction member 361 moves forward and backward along a lower surface 37 of the retaining compartment 32 in the lateral direction Z.

The retaining compartment 32 includes two positioning ribs 38 extending in the connection-disconnection direction X and located at positions separated from the removal restriction units 36 in the removal direction X2 (lower side in FIG. 4A). The two positioning ribs 38 are used to roughly set the position of the waste liquid container 50 in the retaining compartment 32 in the lateral direction Z and the vertical direction Y. The positioning ribs 38 are located at substantially the same positions as the removal restriction units 36 in the vertical direction Y.

The structure supporting the discharge unit 33 and the structure of the discharge unit 33 will now be described with reference to FIGS. 3, 5A, and 5B.

Figure 5A:
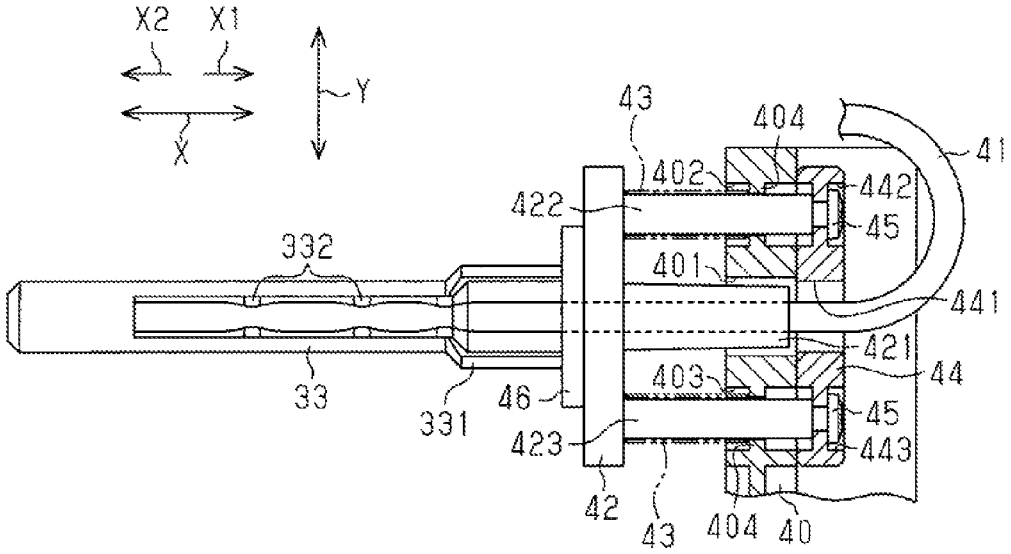
FIG. 5A is a cross-sectional view of a discharge unit and a structure supporting the discharge unit in the container retaining unit of FIG. 3.
Figure 5B:
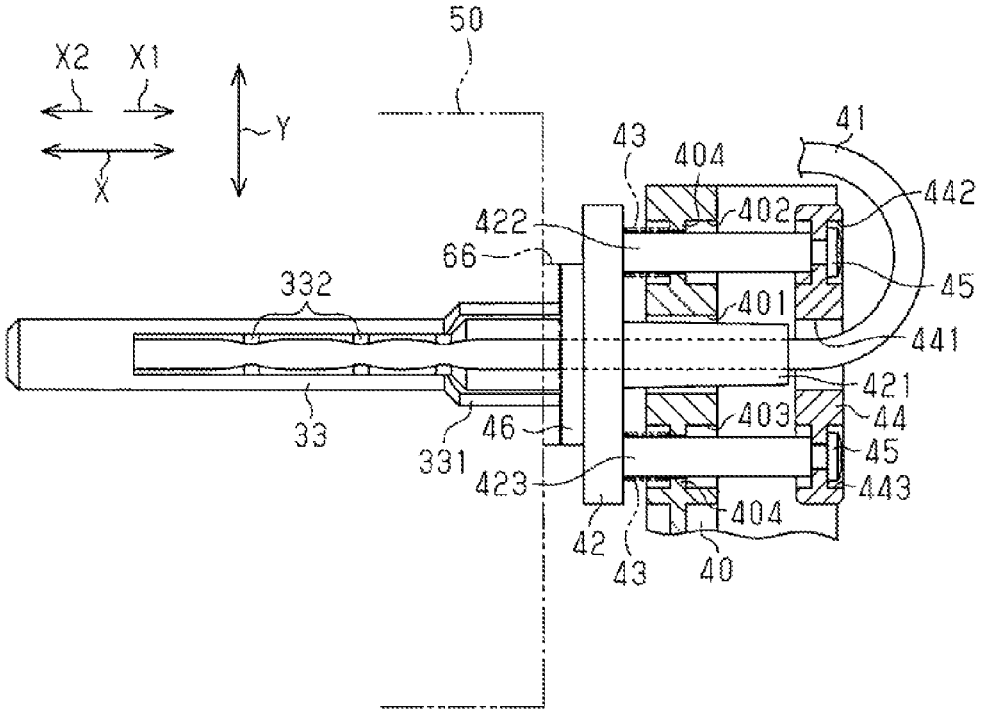
FIG. 5B is a cross-sectional view of the discharge unit and the structure supporting the discharge unit in the container retaining unit of FIG. 3.

As shown in FIGS. 3, 5A, and 5B, the structure supporting the discharge unit 33 includes a base 40, which is slightly movable in the vertical direction Y and the lateral direction Z. The base 40 includes three bores 401, 402, and 403 extending in the connection-disconnection direction X (sideward direction as viewed in FIGS. 5A and 5B) and arranged next to one another in the vertical direction Y. Among the bores 401 to 403, the middle one is referred to as the middle bore 401, the highest one is referred to as the upper bore 402, and the lowest one is referred to as the lower bore 403. In this case, the middle bore 401 is arranged coaxially with the discharge unit 33, which is tubular. The upper bore 402 and the lower bore 403 each include an inward-extending flange 404 extending from the middle of the wall surface in the connection-disconnection direction X.

A discharge unit support 42 is coupled to the side of the base 40 oriented in the removal direction X2 (left side as viewed in FIGS. 5A and 5B). The discharge unit support 42 includes a basal tube 421, which is substantially cylindrical and projects in the insertion direction X1 (right side as viewed in FIGS. 5A and 5B). The basal tube 421 has an outer diameter that is smaller than the diameter of the middle bore 401. Thus, the basal tube 421 is movable in the middle bore 401 in the connection-disconnection direction X. A waste liquid tube 41, through which waste liquid flows, is inserted through the basal tube 421. The waste liquid tube 41 is flexible.

Rods 422 and 423 respectively project in the insertion direction X1 from the discharge unit support 42 at the upper and lower sides of the basal tube 421. The upper rod 422 is inserted through the upper bore 402. The diameter of the rod 422 is slightly smaller than the inner diameter of the inward-extending flange 404 in the upper bore 402. The lower rod 423 is inserted through the lower bore 403. The diameter of the rod 423 is slightly smaller than the inner diameter of the inward-extending flange 404 in the lower bore 403. The distal ends (right ends as viewed in FIGS. 5A and 5B) of the rods 422 and 423 are located at positions separated from the base 40 in the insertion direction X1.

A coil spring 43, which is one example of a device biasing member, is arranged on each of the rods 422 and 423. The coil spring 43 has one end (right end as viewed in FIGS. 5A and 5B) supported by the inward-extending flange 404 in the corresponding one of the bores 402 and 403 and another end (left end as viewed in FIGS. 5A and 5B) supported by the discharge unit support 42. Thus, the coil spring 43 is located between the base 40 and the discharge unit support 42. The coil spring 43 is extended and contracted in cooperation with the movement of the discharge unit support 42 relative to the base 40 in the connection-disconnection direction X.

A coupling plate 44, which couples the discharge unit support 42 to the base 40, is arranged on the side of the base 40 oriented in the insertion direction X1 (right side as viewed in FIGS. 5A and 5B). A middle communication bore 441, which is coaxial with middle bore 401 of the base 40, extends through the substantially middle of the coupling plate 44. The waste liquid tube 41 extends through the middle communication bore 441 and into the basal tube 421.

The coupling plate 44 includes threaded bores 442 and 443 at locations corresponding to the upper bore 402 and the lower bore 403. The distal ends of the rods 422 and 423 inserted through the upper bore 402 and the lower bore 403 are located in the threaded bores 442 and 443, respectively. Fastening screws 45 fasten the distal ends of the rods 422 and 423 in the threaded bores 442 and 443 to the coupling plate 44. Thus, when the discharge unit support 42 moves relative to the base 40 in the connection-disconnection direction X, the coupling plate 44 moves in the connection-disconnection direction X in cooperation with the discharge unit support 42.

An annular seat 46, which is one example of a contacted portion, is arranged on the surface of the discharge unit support 42 oriented in the removal direction X2 (left surface in FIGS. 5A and 5B). The seat 46 is arranged coaxially with the basal tube 421, and the inner side of the seat 46 is in communication with the inner side of the basal tube 421. The waste liquid tube 41 extending through the basal tube 421 is inserted through the seat 46. When the waste liquid container 50 is inserted into the retaining compartment 32 and in a retained state, a portion of the waste liquid container 50 (specifically, a projection 66 that will be described later) contacts the seat 46.

The discharge unit 33 projects from the seat 46 in the removal direction X2. The inner side of the discharge unit 33 is in communication with the inner side of the basal tube 421. The waste liquid tube 41 is drawn into the discharge unit 33. The basal portion of the discharge unit 33 that is continuous with the seat 46 defines a fitting tube 331 having a large outer diameter. Holders 332 are arranged on the inner wall surface of the distal portion separated from the fitting tube 331 in the removal direction X2 to hold the waste liquid tube 41 in the discharge unit 33. The waste liquid flowing through the waste liquid tube 41 is discharged through a discharge port located in the distal end of the discharge unit 33.

The waste liquid container 50 of the present embodiment will now be described with reference to FIGS. 6 to 9.

Figure 6:
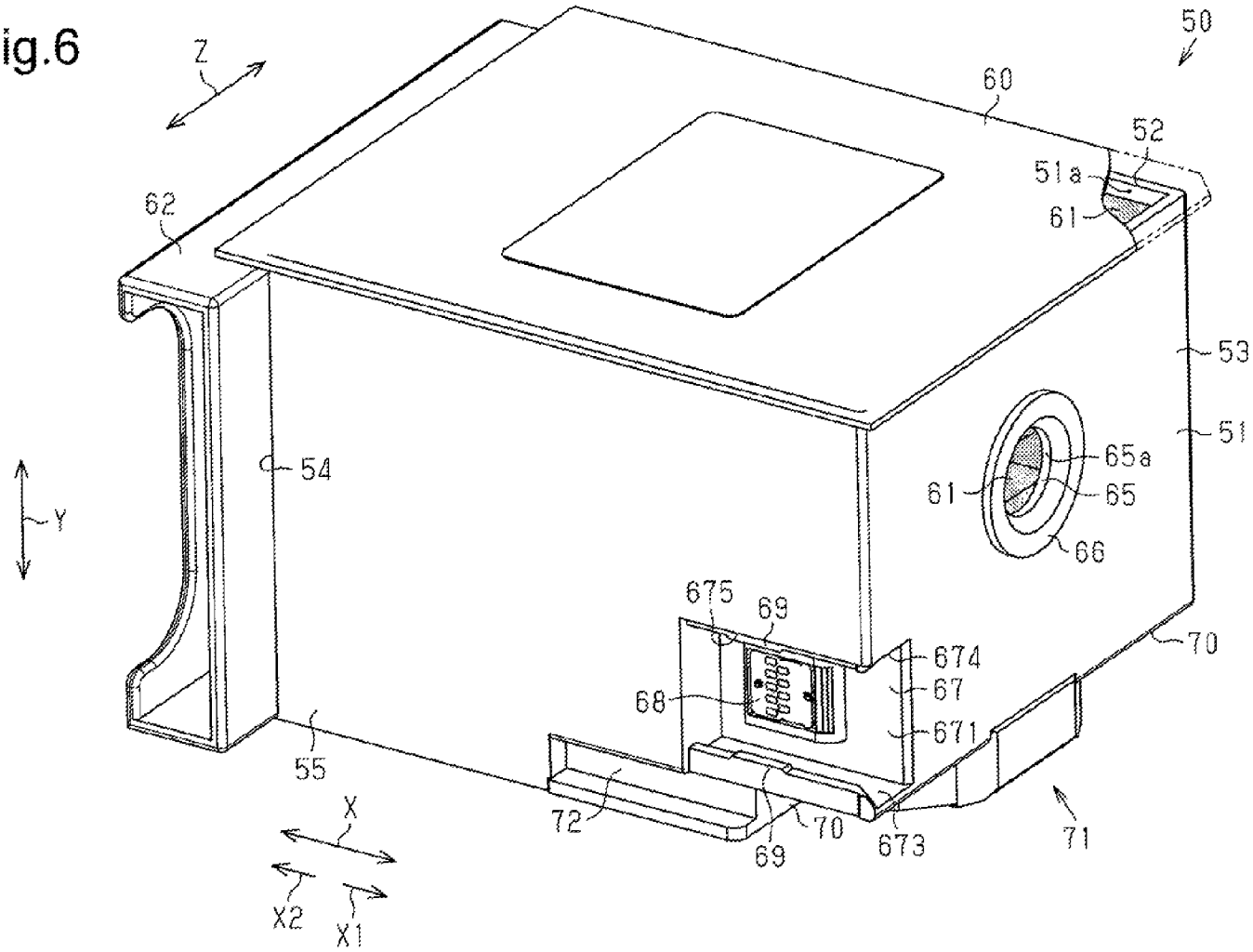
FIG. 6 is a partially cutaway perspective view showing the waste liquid container of FIG. 3.
Figure 7:
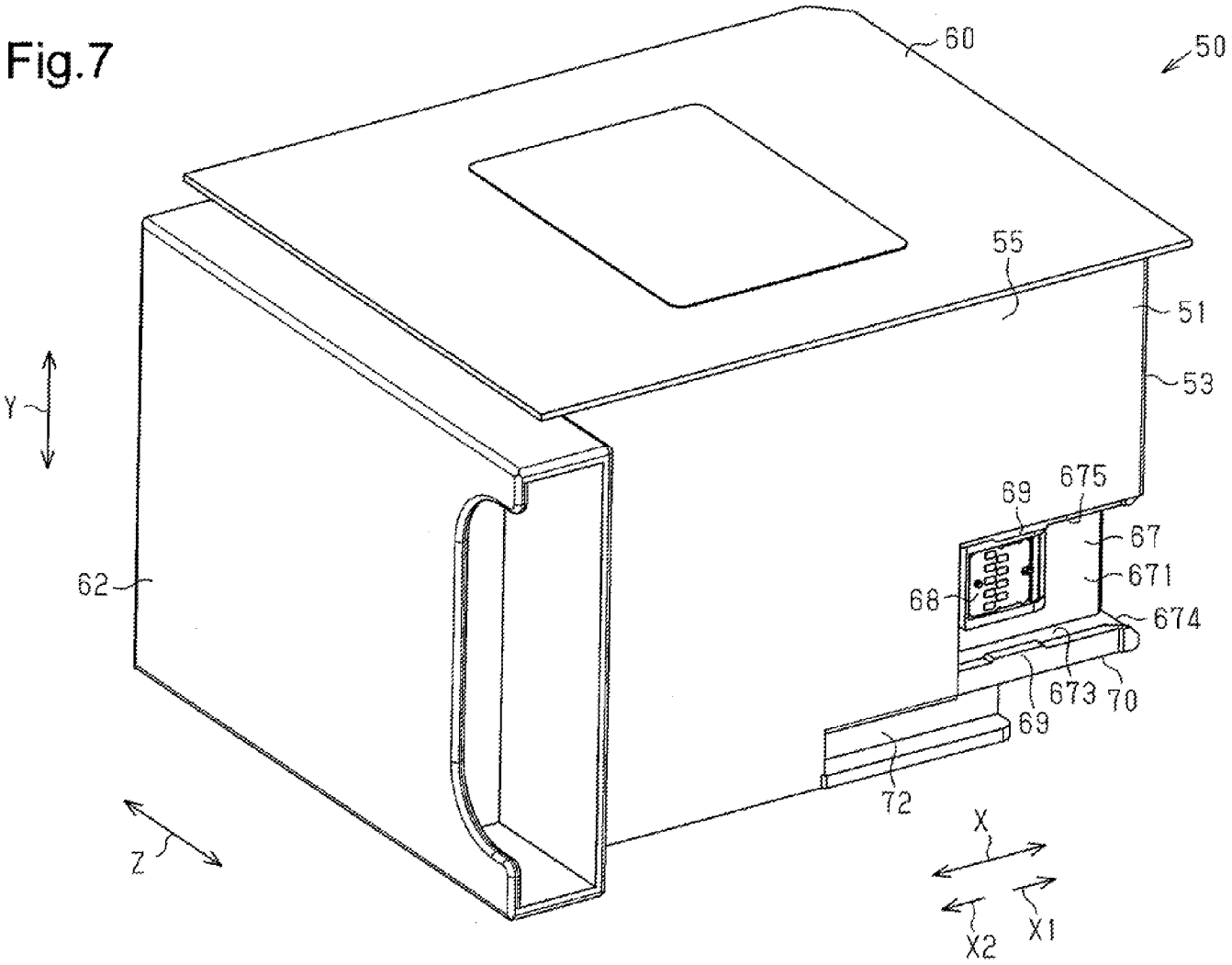
FIG. 7 is a perspective view showing the waste liquid container of FIG. 3.

As shown in FIGS. 6 and 7, the waste liquid container 50 includes a tank 51, which is formed from a synthetic resin. The tank 51 is box-shaped and has an upper opening and a closed bottom. A film 60 covers the upper opening 52 of the tank 51. The upper opening 52 is one example of an opening and the film 60 is one example of a cover. The film 60 includes an atmosphere hole. The tank 51 includes a collection compartment 51*a*. The collection compartment 51*a* accommodates absorption members 61 that are stacked in the vertical direction Y to absorb the waste liquid.

When the upper opening 52 is not covered by the film 60, the collection compartment 51*a* is in communication with the outside of the tank 51 through the upper opening 52. This allows for the absorption members 61 to be arranged in the collection compartment 51*a* through the upper opening 52.

Figure 8:
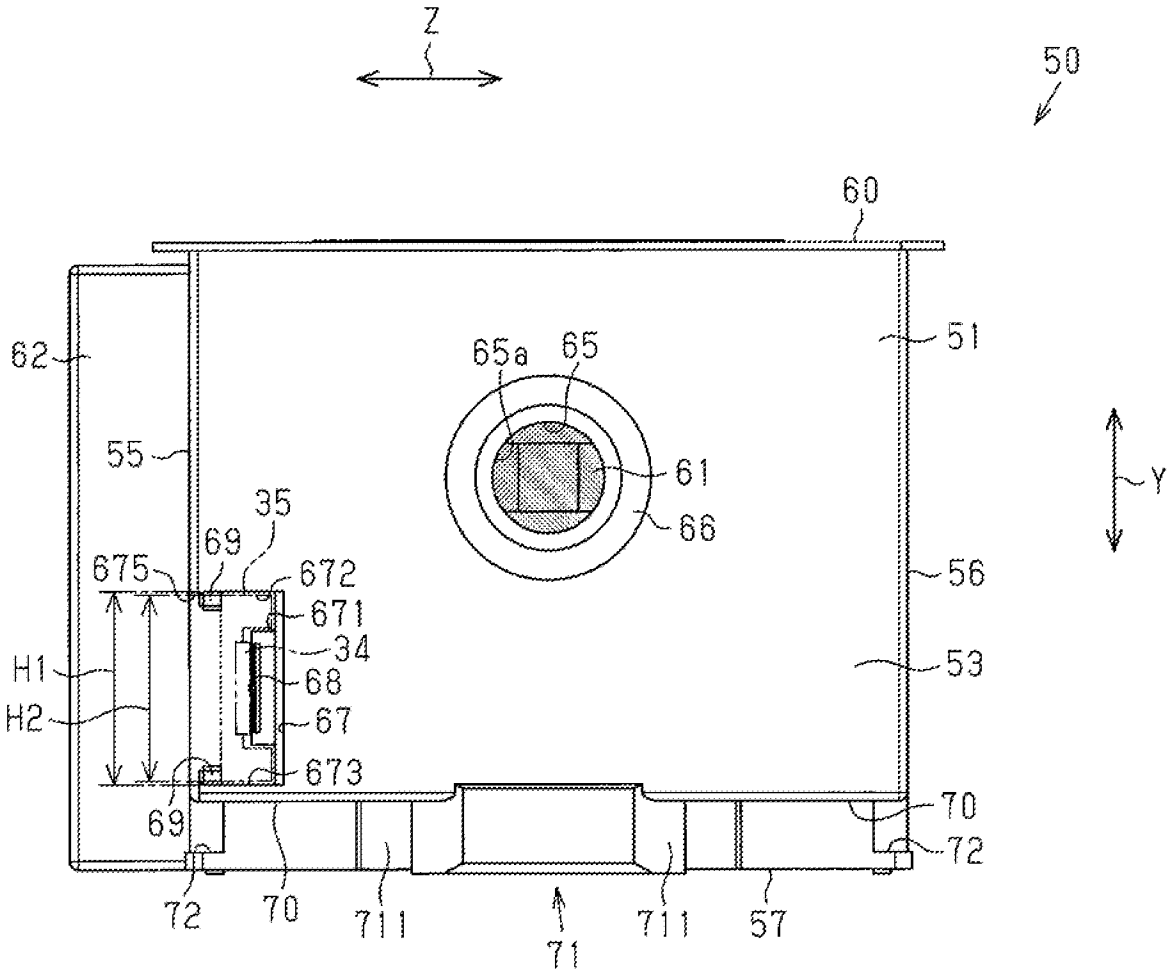
FIG. 8 is a front view showing the waste liquid container of FIG. 3.

The tank 51 includes a front wall 53 oriented in the insertion direction X1 and a rear wall 54 oriented in the removal direction X2. When the tank 51 is in the retained state, the front wall 53 is located at the innermost part of the retaining compartment 32, and the rear wall 54 is located near the retaining port 141. Further, as shown in FIGS. 6 to 8, a first side wall 55 is connected to one end of the front wall 53 in the lateral direction Z and one end of the rear wall 54 in the lateral direction Z. A second side wall 56 connects the other end of the front wall 53 in the lateral direction Z and the other end of the rear wall 54 in the lateral direction Z. The first side wall 55 extends in the removal direction X2 from one end of the front wall 53 in the lateral direction Z. The second side wall 56 extends in the removal direction X2 from the other end of the front wall 53 in the lateral direction Z. A grip 62, which is held by the user when inserting the waste liquid container 50 into the retaining compartment 32 and when removing the waste liquid container 50 from the retaining compartment 32, is coupled to the rear wall 54.

The middle of the front wall 53 of the tank 51 in the lateral direction Z includes a fitted hole 65 that configures a fitted portion. The fitted hole 65 is located in the middle of the front wall 53 in the vertical direction Y. Further, the front wall 53 includes a ring-shaped projection 66, which is one example of an insertion restriction portion and arranged coaxially with the fitted hole 65. When the waste liquid container 50 is in the retained state, the discharge unit 33 of the retaining compartment 32 is fitted into the fitted hole 65, and the distal end of the projection 66 contacts the seat 46. Contact of the projection 66 with the seat 46 restricts movement of the waste liquid container 50 relative to the discharge unit 33 in the insertion direction X1. Further, the biasing force of the coil springs 43 in the removal direction X2 is applied to the waste liquid container 50 through the discharge unit 33 and the seat 46.

The diameter of the fitted hole 65 is substantially equal to the outer diameter of the fitting tube 331 of the discharge unit 33. Thus, when the fitting tube 331 is fitted into the fitted hole 65, the wall surface 65*a* defining the fitted hole 65 contacts the outer circumferential surface of the fitting tube 331. This restricts movement of the discharge unit 33 relative to the waste liquid container 50 in the vertical direction Y and the lateral direction Z. In this regard, the wall surface 65*a* configures one example of a "fitted portion positioner."

As shown in FIGS. 6 to 8, the first side wall 55 of the tank 51 includes a terminal groove 67 extending in the removal direction X2 from where the first side wall 55 and the front wall 53 are connected. The terminal groove 67 is located at a position lower than the fitted hole 65 and the projection 66. The terminal groove 67 includes a bottom surface 671 including a container connection terminal 68, which is electrically connected to an IC chip embedded in the tank 51.

As shown in FIG. 8, an upper surface 672 and a lower surface 673 are surfaces that surround the terminal groove 67. The upper surface 672 and the lower surface 673 are connected by the bottom surface 671. The distance H1 between the upper surface 672 and the lower surface 673 is slightly greater than the length H2 in the vertical direction Y of the terminal support 35, which holds the device connection terminal 34. Thus, when insertion of the waste liquid container 50 into the retaining compartment 32 arranges the device connection terminal 34 in the terminal groove 67 through a front opening 674, the upper surface 672 and the lower surface 673 restrict displacement of the device connection terminal 34 in the vertical direction Y. In this regard, the upper surface 672 and the lower surface 673 configure one example of a "connection terminal positioner" that positions the device connection terminal 34 in the vertical direction Y relative to the container connection terminal 68 in the terminal groove 67.

The upper surface 672 and the lower surface 673 each include a rib 69 extending in the connection-disconnection direction X near an opening 675 of the first side wall 55. When the waste liquid container 50 is in the retained state, the two ribs 69 contact the outer side in the lateral direction Z (left side in FIG. 8) of the terminal support 35 in the terminal groove 67. This restricts separation of the device connection terminal 34 from the container connection terminal 68 toward the outer side in the lateral direction Z. In this regard, the two ribs 69 configure an example of a "separation restriction unit."

The terminal groove 67, which extends in the removal direction X2 from where the first side wall 55 and the front wall 53 are connected, includes a terminating end located closer to the front wall 53 than the rear wall 54 in the connection-disconnection direction X. Thus, the container connection terminal 68 is also located closer to the front wall 53 than the rear wall 54 in the connection-disconnection direction X.

Figure 9:
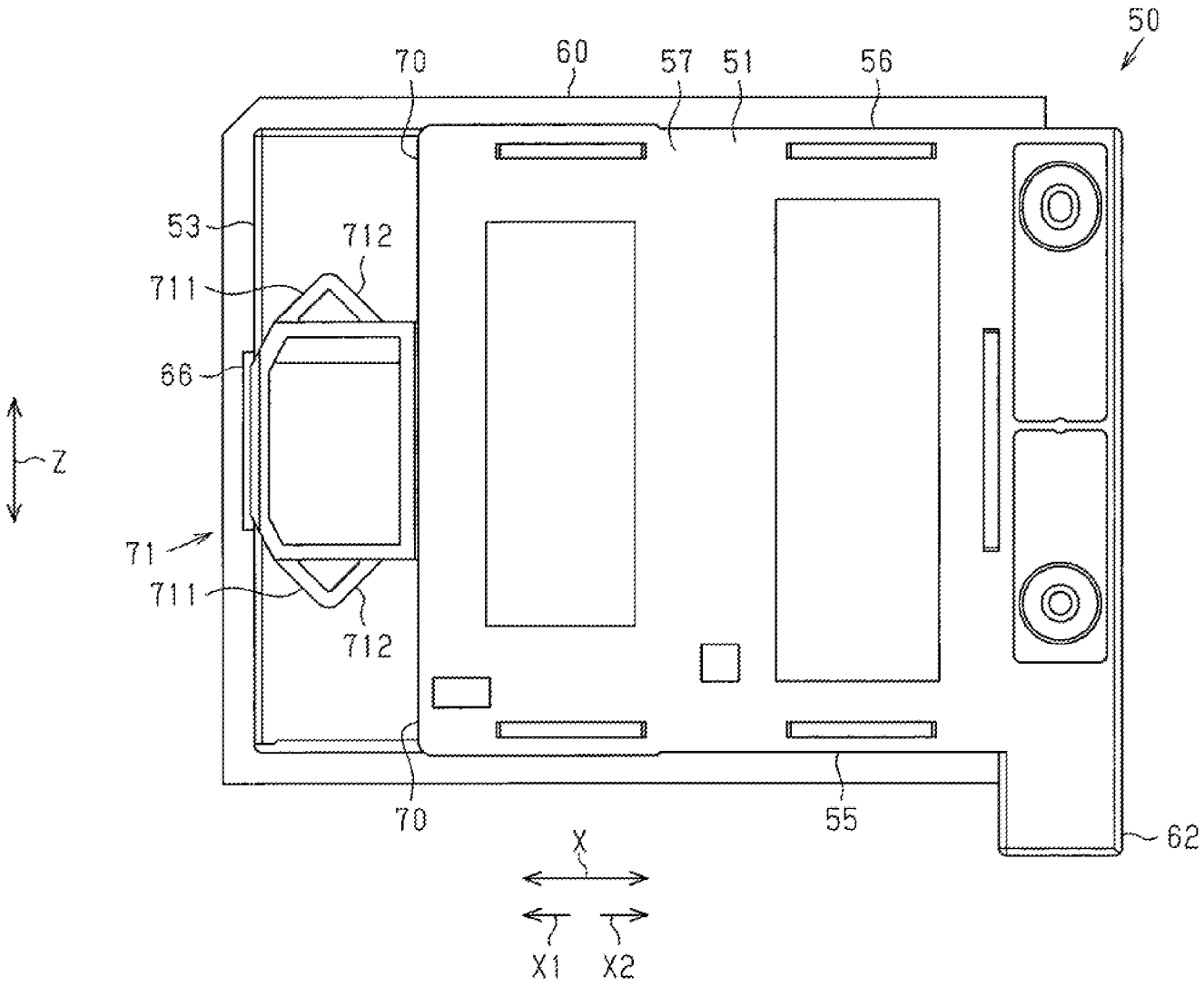
FIG. 9 is a bottom view showing the waste liquid container of FIG. 3.

As shown in FIG. 9, the tank 51 includes a bottom wall 57 including recesses 70 at the side oriented in the insertion direction X1 (left side in FIG. 9). When the waste liquid container 50 is inserted into the retaining compartment 32, the two removal restriction units 36 enter the recesses 70. One of the two recesses 70 opens where the bottom wall 57 is connected to the front wall 53 and opens where the bottom wall 57 is connected to the first side wall 55. The other recess 70 is opens where the bottom wall 57 is connected to the front wall 53 and opens where the bottom wall 57 is connected to the second side wall 56.

The bottom wall 57 includes an engaged portion 71 at the side oriented in the insertion direction X1 and located toward the inner side in the lateral direction Z from the first side wall 55 and the second side wall 56. More specifically, the engaged portion 71 is located at a position lower than the fitted hole 65, the projection 66, and the container connection terminal 68. Further, the engaged portion 71 is located closer to the front wall 53 than the container connection terminal 68 in the connection-disconnection direction X.

The engaged portion 71 includes two guide surfaces 711, which are arranged at the two sides in the lateral direction Z, and two contacted surfaces 712, which are separated from the guide surfaces 711 in the removal direction X2 (toward the right in FIG. 9). The guide surfaces 711 are inclined surfaces that gradually extend toward the outer side in the lateral direction Z at positions located further in the removal direction X2. When inserting the waste liquid container 50 into the retaining compartment 32, the distal ends of the restriction members 361 in the removal restriction units 36 contact the guide surfaces 711. Under this situation, when the waste liquid container 50 is moved in the insertion direction X1, the guide surfaces 711 move back the restriction members 361 toward the outer side in the lateral direction Z. In this regard, the guide surfaces 711 form an example of a "guide" that guides the backward movement of the restriction members 361 toward the outer side in the lateral direction Z during the insertion of the waste liquid container 50 into the retaining compartment 32.

The contacted surfaces 712 are continuous with the guide surfaces 711. Further, the contacted surfaces 712 are inclined surfaces that extend from where the guide surfaces 711 are connected gradually toward the inner side in the lateral direction Z at positions located further in the removal direction X2. During the insertion of the waste liquid container 50 into the retaining compartment 32, as the guide surfaces 711 reach positions separated from the removal restriction units 36 in the insertion direction X1, the restriction members 361 of the removal restriction units 36 start to contact the contacted surfaces 712. Here, the biasing force of the restriction biasing members 362 is applied to the contacted surfaces 712 through the restriction members 361. As a result, the two restriction biasing members 362 push the engaged portion 71, which includes the contacted surfaces 712, in the insertion direction X1. This restricts movement of the waste liquid container 50 in the removal direction X2. In this regard, the contacted surfaces 712 configure one example of a "contacted portion" that contacts the removal restriction units 36 and restricts movement of the waste liquid container 50 in the removal direction X2.

As shown in FIGS. 6 to 8, the two sides of the bottom wall 57 in the lateral direction Z of the tank 51 includes positioning guide grooves 72 that are capable of receiving the positioning ribs 38 in the retaining compartment 32. The two positioning guide grooves 72 are located at positions separated from the engaged portion 71 in the removal direction X2.

The insertion of the waste liquid container 50 into the retaining compartment 32 will now be described with reference to FIGS. 10 to 16.

Figure 10:
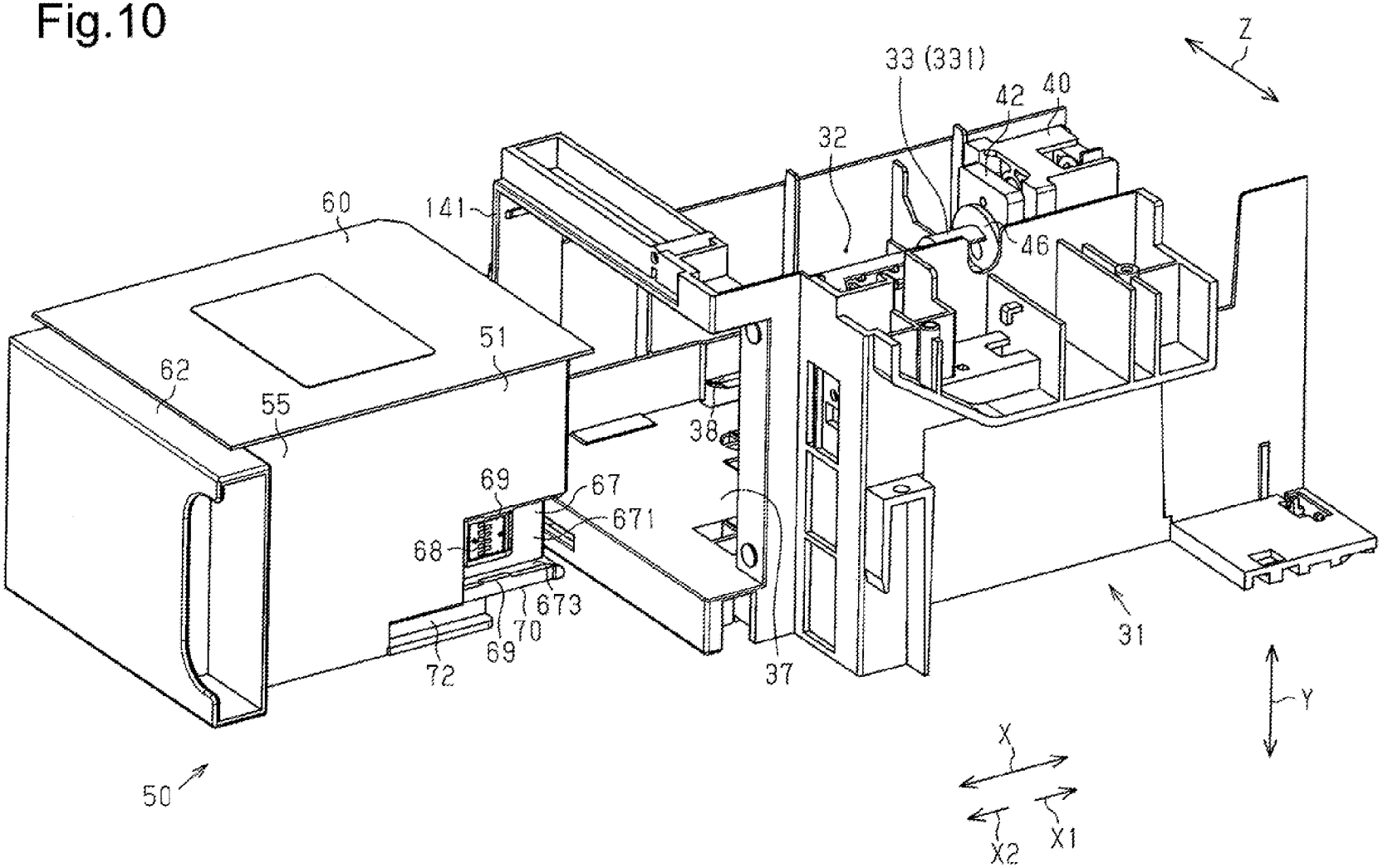
FIG. 10 is a perspective view showing the waste liquid container of FIG. 3 prior to insertion into a retaining compartment of a container retaining unit.
Figure 11:
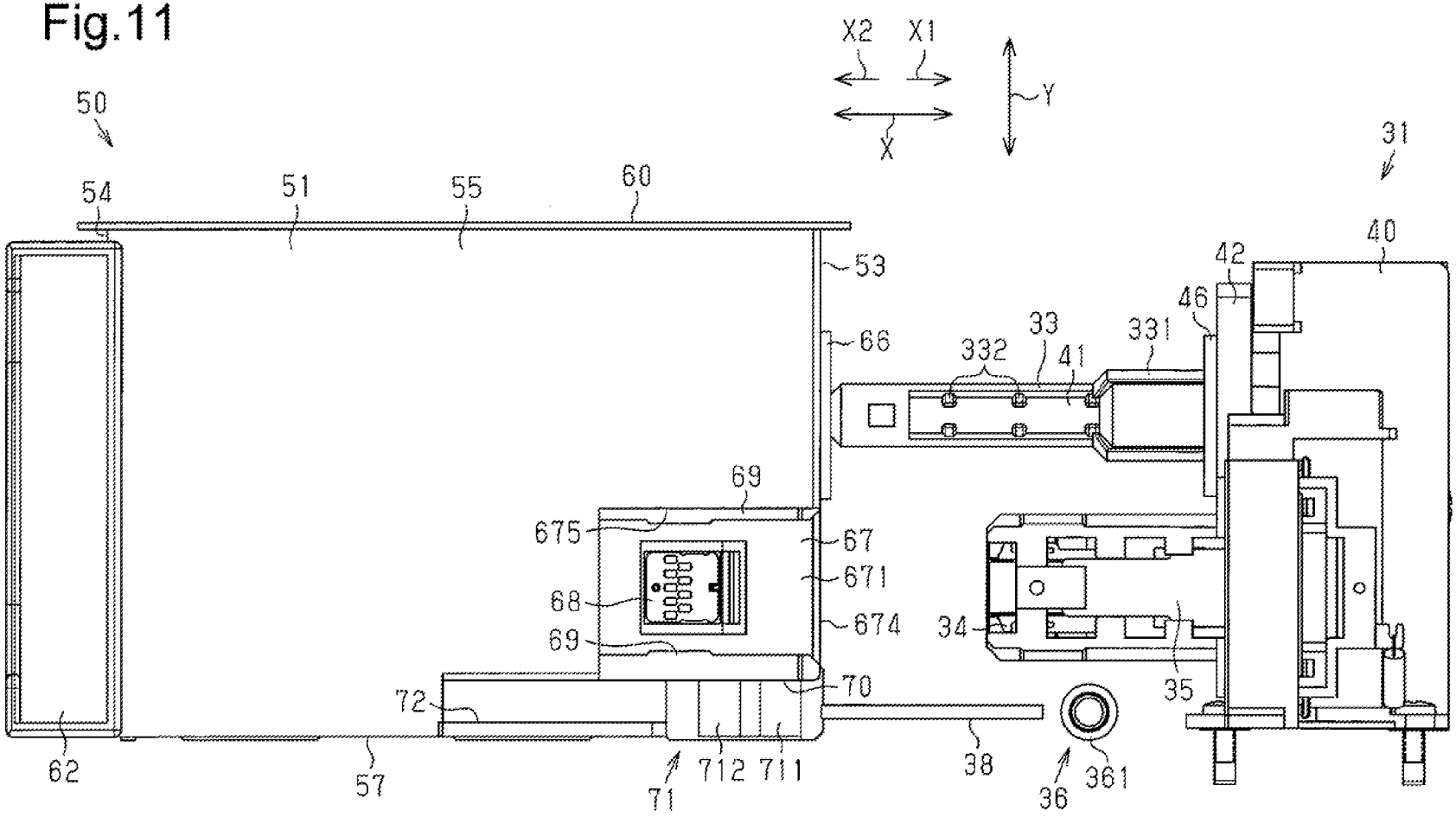
FIG. 11 is a side view showing the insertion of the waste liquid container of FIG. 3 into the retaining compartment.

Referring to FIG. 10, the waste liquid container 50 is inserted through the retaining port 141 into the retaining compartment 32. As a result, referring to FIGS. 11 and 12, the discharge unit 33, which is located at the innermost part of the retaining compartment 32, is fitted into the fitted hole 65 in the front wall 53 of the waste liquid container 50, from the distal end of the discharge unit 33. The distal portion (left side in FIG. 11) of the discharge unit 33 extending from the fitting tube 331, has an outer diameter that is smaller than the diameter of the fitted hole 65 and the inner diameter of the projection 66. Under this situation, the discharge unit 33 is still slightly movable in the vertical direction Y and the lateral direction Z.

Figure 12:
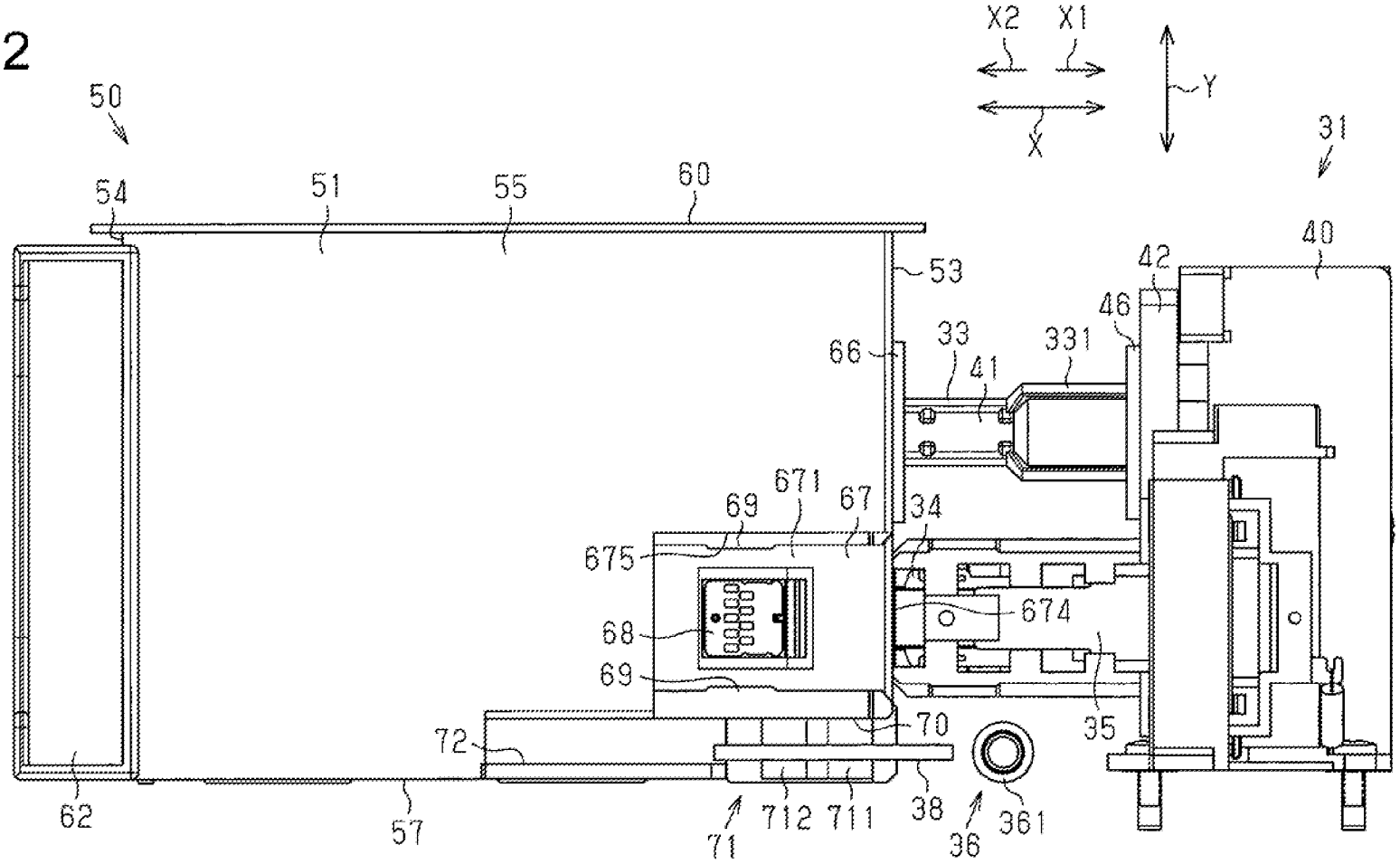
FIG. 12 is a side view showing the insertion of the waste liquid container of FIG. 3 into the retaining compartment.
Figure 13:
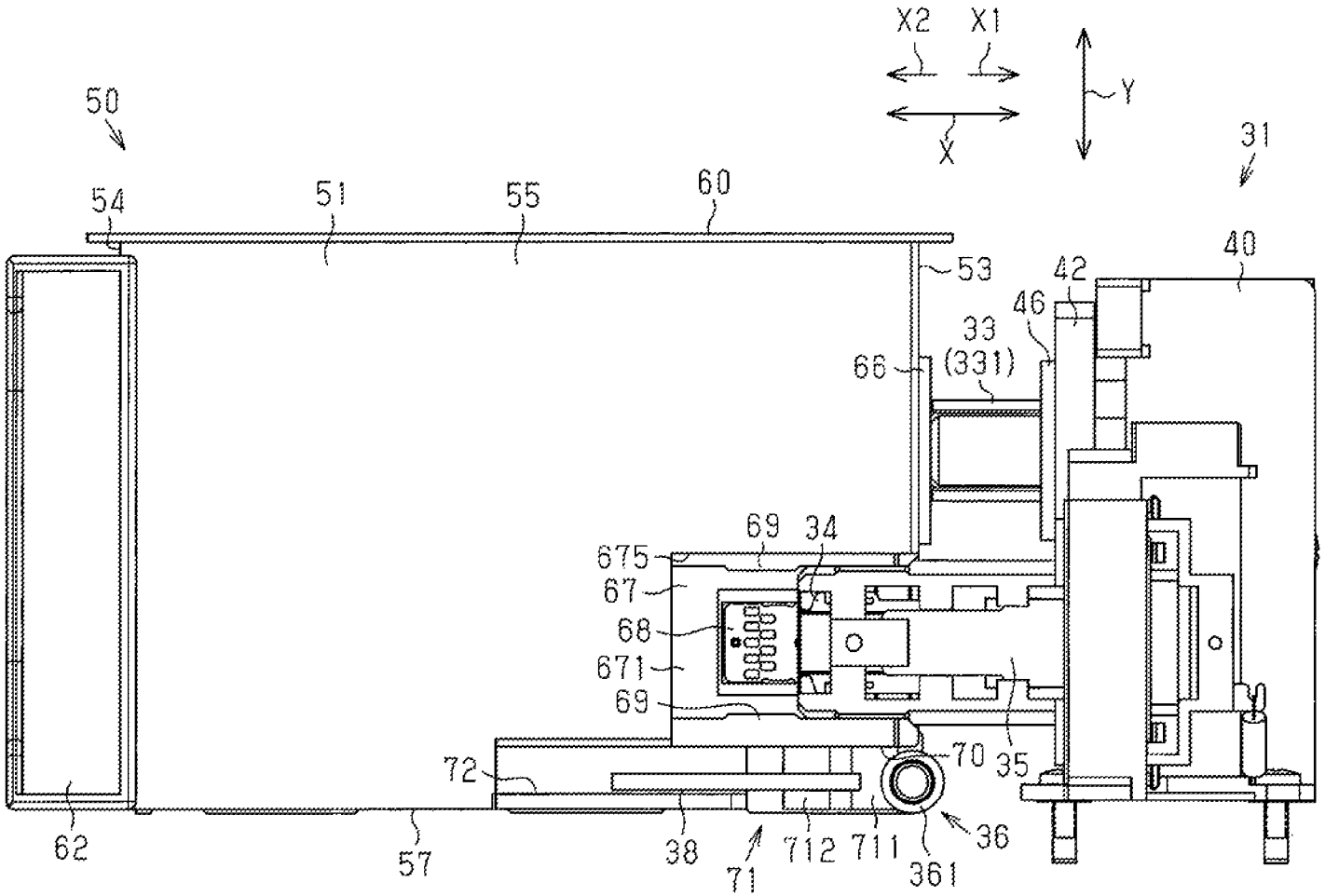
FIG. 13 is a side view showing the insertion of the waste liquid container of FIG. 3 into the retaining compartment.

Referring to FIGS. 12 and 13, when the distal portion of the discharge unit 33 is located in the fitted hole 65 of the waste liquid container 50, the positioning ribs 38 are received in the positioning guide grooves 72. This roughly positions the waste liquid container 50 with respect to the retaining compartment 32 in the vertical direction Y and the lateral direction Z.

Further, as shown in FIGS. 12 and 13, at this stage, the terminal groove 67 of the waste liquid container 50 receives the terminal support 35, which supports the device connection terminal 34, through the opening 674. As a result, in the terminal groove 67, the upper surface 672 and the lower surface 673 restrict displacement of the terminal support 35 in the vertical direction Y. In the terminal groove 67, the two ribs 69 restrict displacement of the terminal support 35 toward the outer side in the lateral direction Z.

Figure 14:
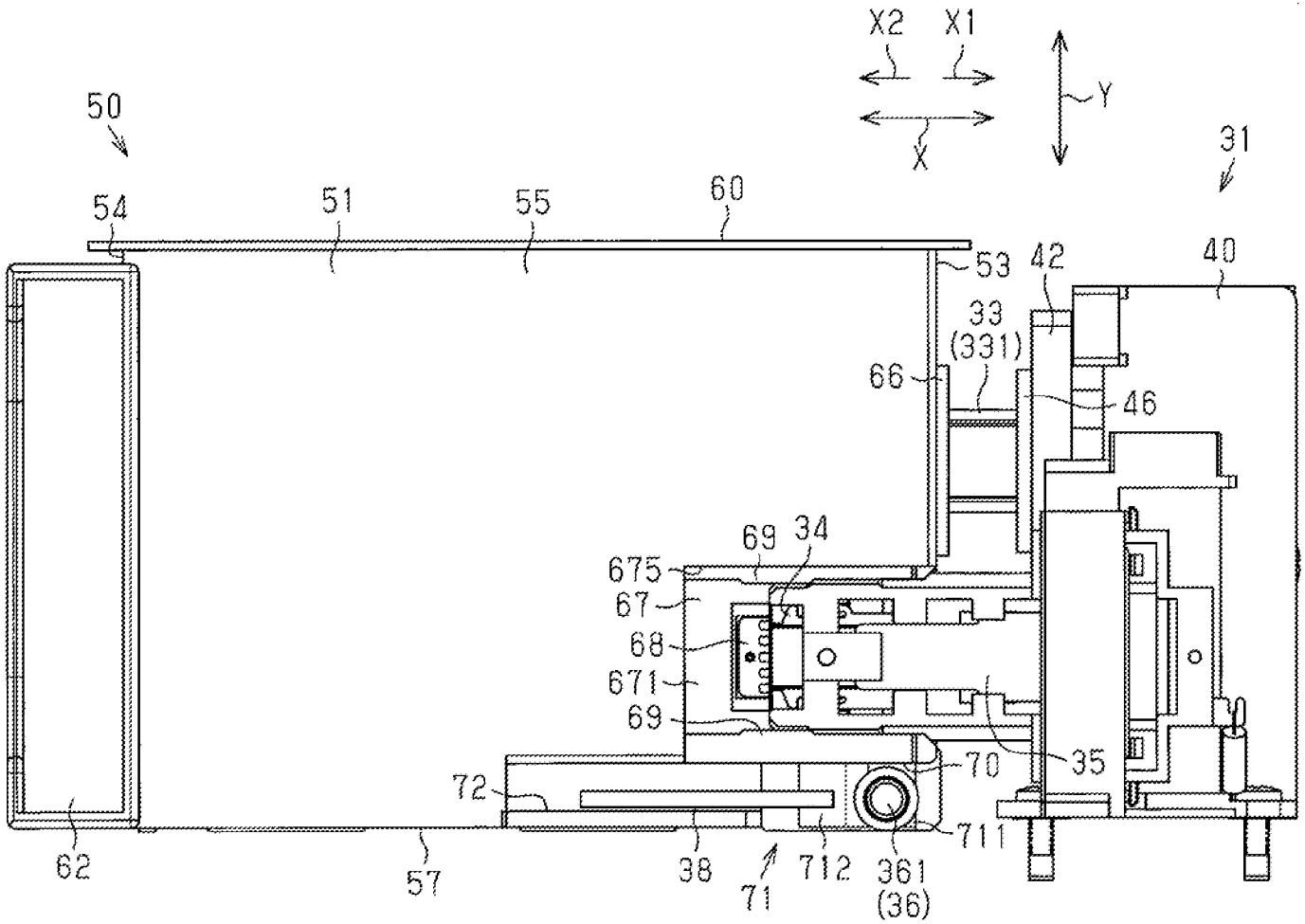
FIG. 14 is a side view showing the insertion of the waste liquid container of FIG. 3 into the retaining compartment.

Then, referring to FIG. 14, the fitting tube 331 of the discharge unit 33 is fitted to the fitted hole 65 of the waste liquid container 50. The outer diameter of the fitting tube 331 is substantially equal to the diameter of the fitted hole 65. Thus, the wall surface 65*a* defining the fitted hole 65 comes into contact with the outer circumferential surface of the fitting tube 331. This restricts movement of the discharge unit 33 relative to the waste liquid container 50 in the vertical direction Y and the lateral direction Z. In this case, the waste liquid container 50, which is moved in the insertion direction X1, pushes and moves the discharge unit support 42, which supports the discharge unit 33, in the insertion direction X1 (refer to FIGS. 5A and 5B). As a result, each coil spring 43 is contracted. This increases the force of each coil spring 43 biasing the discharge unit support 42.

Further, as shown in FIG. 14, under this situation, the distal ends of the restriction members 361 of the removal restriction units 36 come into contact with the guide surfaces 711 in the engaged portion 71 of the waste liquid container 50. When the waste liquid container 50 is further moved in the insertion direction X1 under this situation, the guide surfaces 711 move back the restriction members 361 toward the outer side in the lateral direction Z against the biasing force of the restriction biasing members 362. Further movement of the waste liquid container 50 in the insertion direction X1 results in the distal ends of the restriction members 361 coming into contact with where the guide surfaces 711 and the contacted surfaces 712 are connected. This ends the backward movement of the restriction members 361 toward the outer side in the lateral direction Z. Then, when the distal ends of the restriction members 361 come into contact with the contacted surfaces 712, movement of the waste liquid container 50 in the insertion direction X1 moves the restriction members 361 toward the inner side in the lateral direction Z.

Figure 15:
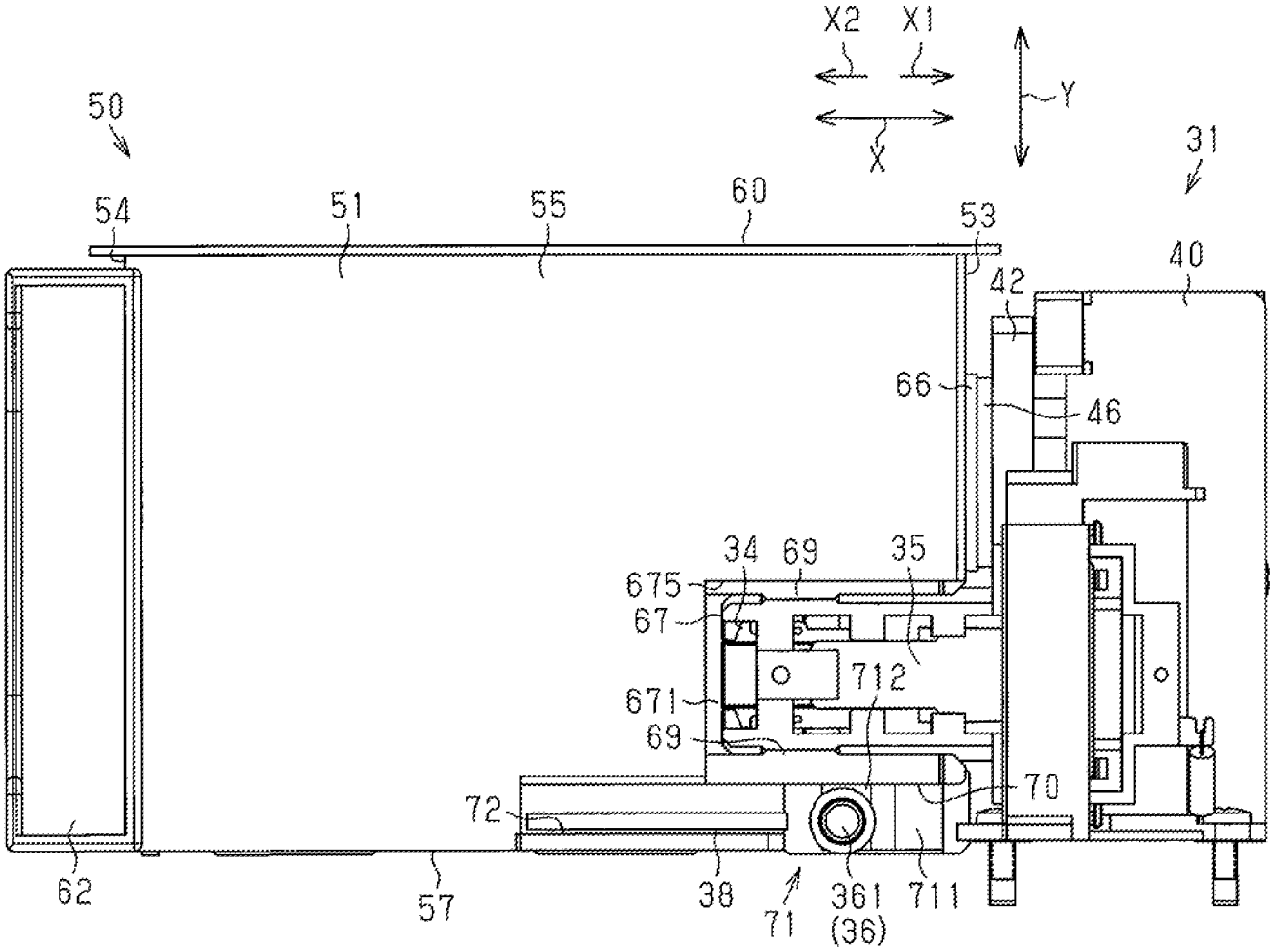
FIG. 15 is a side view showing the waste liquid container of FIG. 3 inserted in the retaining compartment.
Figure 16:
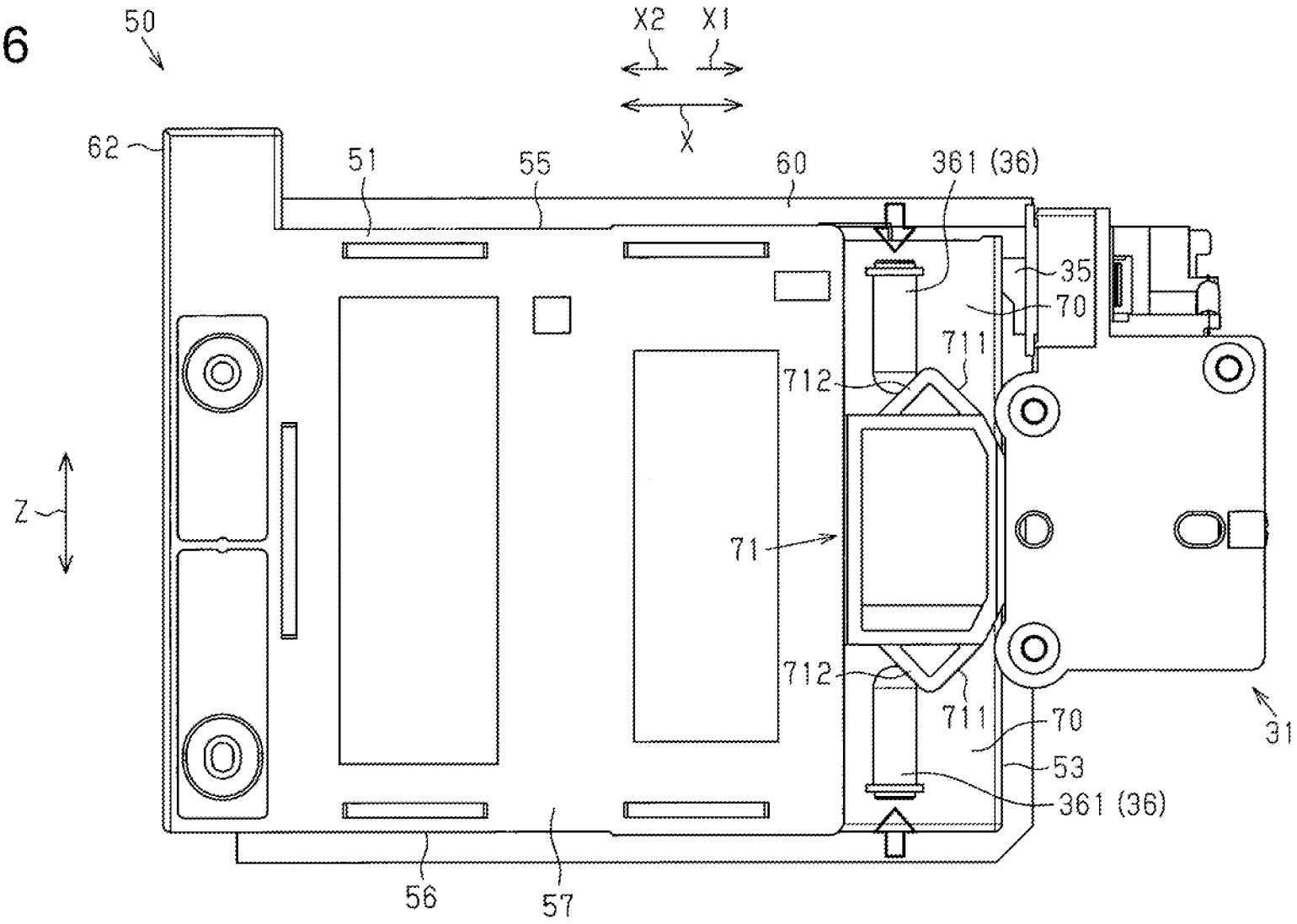
FIG. 16 is a bottom view showing the waste liquid container of FIG. 3 inserted in the retaining compartment.

Referring to FIG. 15, when the projection 66 of the waste liquid container 50 contacts the seat 46, which is connected to the basal end of the discharge unit 33, movement of the waste liquid container 50 in the insertion direction X1 is restricted by the seat 46. In this situation, the waste liquid container 50 is in a retained state. In such a retained state, as shown in FIG. 16, the restriction members 361 of the removal restriction units 36 are in contact with the contacted surfaces 712 of the engaged portion 71. This restricts movement of the engaged portion 71 (i.e., waste liquid container 50) in the removal direction X2. In this case, biasing force is applied from the restriction biasing members 362 of the removal restriction units 36 to the contacted surfaces 712. Thus, the removal restriction units 36 push the engaged portion 71 in the insertion direction X1.

Figure 17:
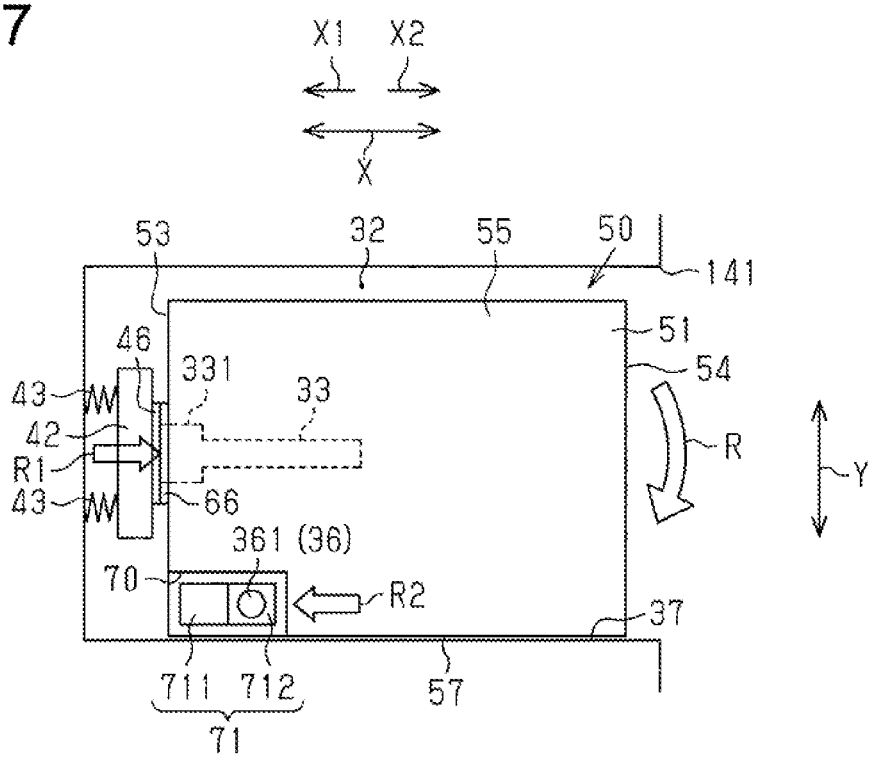
FIG. 17 is a schematic diagram showing the waste liquid container of FIG. 3 pushed against the lower surface of the retaining compartment.

Consequently, referring to FIG. 17, the retained waste liquid container 50 is pushed against the lower surface 37 of the recording unit 12 of the present embodiment. More specifically, the biasing force of the two coil springs 43 in the removal direction X2 (hereafter referred to as "the first pushing force R1") is applied through the discharge unit 33 and the seat 46 to the waste liquid container 50 that is in the retained state. The removal restriction units 36, which are located at positions lower than the discharge unit 33, restrict movement of the retained waste liquid container 50 in the removal direction X2. Further, the pushing force of the removal restriction units 36 in the insertion direction X1 (hereafter referred to as "the second pushing force R2") is applied to the engaged portion 71. As a result, the first pushing force R1 and the second pushing force R2 are converted to a rotational force R acting in a rotation direction about an axis extending in the lateral direction Z (clockwise direction in FIG. 17). The rotational force R acts on the waste liquid container 50. Further, the above distance H1 is slightly greater than the above length H2. This allows for slight movement of the device connection terminal 34 in the terminal groove 67. Thus, slight rotation of the waste liquid container 50 is allowed when the rotational force R is applied. This pushes the waste liquid container 50 against the lower surface 37 and stably positions the waste liquid container 50 in the retaining compartment 32.

In the retained state, satisfactory connection is maintained between the container connection terminal 68 and the device connection terminal 34. Thus, the IC chip of the waste liquid container 50 is electrically connected to the controller of the all-in-one printer 11. This enables the controller to read information stored in the IC chip and write new information to the IC chip.

When removing the waste liquid container 50 from the retaining compartment 32, movement of the waste liquid container 50 in the removal direction X2 moves back the restriction members 361 of the removal restriction units 36 toward the outer side in the lateral direction Z with the contacted surfaces 712 of the engaged portion 71. Contact of the restriction members 361 with where the contacted surfaces 712 and the guide surfaces 711 are connected ends the backward movement of the restriction members 361. Then, when the restriction members 361 contact the guide surfaces 711, movement of the waste liquid container 50 in the removal direction X2 moves the restriction members 361 toward the inner side in the lateral direction Z.

The above embodiment has the advantages described below.

(1) When the waste liquid container 50 is inserted into the retaining compartment 32 of the all-in-one printer 11, the discharge unit 33 is fitted into the fitted hole 65. When the projection 66 contacts the seat 46, movement of the waste liquid container 50 in the insertion direction X1 is restricted in the retaining compartment 32. When the waste liquid container 50 is in the retained state, the removal restriction units 36 contact the contacted surfaces 712, which are located at positions lower than the fitted hole 65 and the projection 66, to restrict movement of the waste liquid container 50 in the removal direction X2. In the retained state, the biasing force of the coil springs 43 acting in the removal direction X2 is applied through the discharge unit 33 and the seat 46 to the waste liquid container 50. As a result, in the retained state, the biasing force from the coil springs 43 is converted to the rotational force R acting about an axis extending in the lateral direction Z. The rotational force R pushes the waste liquid container 50 against the lower surface 37. This stably positions the waste liquid container 50 in the retaining compartment 32.

Further, the engaged portion 71 including the contacted surfaces 712 is located at the inner side of the first side wall 55 of the waste liquid container 50 in the lateral direction Z. Thus, in contrast with when an engaged portion is located at the outer side of the first side wall 55 of the waste liquid container 50 in the lateral direction Z, there is no need for the retaining compartment 32 to be provided with space allowing for movement of the engaged portion when the waste liquid container 50 is moved in the insertion direction X1 or the removal direction X2. This allows the retaining compartment 32 to be reduced in size, while stably positioning the waste liquid container 50 when the waste liquid container 50 is in a retained state inserted into the retaining compartment 32.

(2) For example, when the engaged portion 71 and the container connection terminal 68 are laid out using the position where the fitted hole 65 is formed as a reference, a shorter distance from the reference position facilitates the positioning of the engaged portion 71 and the container connection terminal 68. In this regard, the fitted hole 65, the engaged portion 71, and the container connection terminal 68 are gathered at the front portion of the waste liquid container 50 in the present embodiment. Thus, when using one of the fitted hole 65, the engaged portion 71, and the container connection terminal 68 as a reference when manufacturing the waste liquid container 50, the positioning accuracy is increased for the remaining portions.

(3) The arrangement of the engaged portion 71, which restricts movement of the retained waste liquid container 50 in the removal direction X2, at the front of the waste liquid container 50 increases the efficiency for converting the first pushing force R1 to the rotational force R. In this manner, by increasing the rotational force R, the waste liquid container 50 may be effectively pushed against the lower surface 37. Thus, the waste liquid container 50 may be stably positioned in the retaining compartment 32.

(4) The arrangement of the guide surfaces 711 in the engaged portion 71 allows the restriction members 361 of the removal restriction units 36 to be moved back toward the outer side in the lateral direction Z when inserting the waste liquid container 50 into the retaining compartment 32. Accordingly, the removal restriction units 36 do not interfere with the movement of the waste liquid container 50 in the insertion direction X1. This allows the waste liquid container 50 to be smoothly inserted into the retaining compartment 32.

(5) The contacted surfaces 712 of the engaged portion 71 is inclined toward the outer side in the lateral direction Z as the front wall 53 of the waste liquid container 50 becomes closer. This allows the restriction members 361 of the removal restriction units 36 to be moved back toward the outer side in the lateral direction Z when removing the waste liquid container 50 from the retaining compartment 32. Accordingly, the removal restriction units 36 do not interfere with the movement of the waste liquid container 50 in the removal direction X2. This allows the waste liquid container 50 to be smoothly removed from the retaining compartment 32.

(6) Further, the contacted surfaces 712 are inclined so that the second pushing force R2 acts on the engaged portion 71. The second pushing force R2 acts in a direction opposite to the first pushing force R1. Thus, in comparison with when the second pushing force R2 does not act on the engaged portion 71, the rotational force R may be increased. Accordingly, the waste liquid container 50 is effectively pushed against the lower surface 37. This stably positions the waste liquid container 50 in the retaining compartment 32.

(7) The removal restriction units 36 are arranged at the two sides of the retaining compartment 32 in the lateral direction Z. The engaged portion 71 of the waste liquid container 50 includes the contacted surfaces 712 at the two sides in the lateral direction Z. Thus, movement of the waste liquid container 50 in the removal direction X2 is restricted at the two sides in the lateral direction Z. Accordingly, in comparison with when restricting movement of the waste liquid container 50 in the removal direction X2 at only one side, the retained waste liquid container 50 may be positioned further stably.

(8) When the terminal groove 67 of the waste liquid container 50 receives the device connection terminal 34, the upper surface 672 and the lower surface 673 restrict movement of the device connection terminal 34 in the vertical direction Y relative to the container connection terminal 68. This maintains satisfactory contact between the container connection terminal 68 and the device connection terminal 34.

(9) When the device connection terminal 34 is located in the terminal groove 67 of the waste liquid container 50, the ribs 69 restrict displacement of the device connection terminal 34 toward the outer side in the lateral direction Z. This maintains satisfactory contact between the container connection terminal 68 and the device connection terminal 34.

(10) When the container connection terminal 68 projects out of the first side wall 55, the retaining compartment 32 will need space allowing for movement of the container connection terminal 68. However, in the waste liquid container 50 of the present embodiment, the container connection terminal 68 is located in the terminal groove 67. Thus, there is no need to provide such space for the container connection terminal 68 in the retaining compartment 32. This allows for reduction in the space used by the retaining compartment 32.

(11) The diameter of the fitted hole 65 is substantially equal to the outer diameter of the fitting tube 331 of the discharge unit 33. Thus, when the fitting tube 331 is inserted into the fitted hole 65, the wall surface 65*a* defining the fitted hole 65 contacts the outer circumferential surface of the fitting tube 331. This restricts displacement of the discharge unit 33 relative to the waste liquid container 50 in the lateral direction Z and the vertical direction Y. Accordingly, the correct positional relationship may be maintained between the waste liquid container 50 and the discharge unit 33, and the waste liquid that flows out of the discharge unit 33 may be appropriately received by the collection compartment 51*a* of the waste liquid container 50.

(12) The tank 51 of the waste liquid container 50 includes the upper opening 52, through which the collection compartment 51*a* and the outside are in communication. Thus, the absorption members 61 may be arranged in the collection compartment 51*a* through the upper opening 52.

(13) The upper opening 52 of the tank 51 is covered with the film 60. This reduces leakage of the waste liquid from the collection compartment 51*a* through the upper opening 52.

The above embodiment may be modified as described below.

As long as the upper opening 52 can be covered in the retained state, any component that can be attached to and removed from the tank 51 may be used to cover the upper opening 52 of the tank 51.

The film 60 may be joined with the tank 51 by performing thermal welding or by using an adhesive.

The upper opening 52 of the tank 51 does not have to be covered by a cover such as the film 60 as long as the absorption members 61 are arranged in the collection compartment 51*a* of the waste liquid container 50 and the waste liquid discharged from the discharge unit 33 is absorbed in the absorption members 61.

The absorption members 61 do not have to be arranged in the collection compartment 51*a* as long as the opening 52 of the tank 51 is covered by a cover such as the film 60.

The diameter of the fitted hole 65 of the waste liquid container 50 may be larger than the outer diameter of the fitting tube 331 of the discharge unit 33. In this case, projections projecting toward the inner side in the radial direction may be arranged in the circumferential direction on the wall surrounding the fitted hole 65, and the fitting tube 331 may be supported by the distal ends of the projections. The projections supporting the fitting tube 331 configure one example of a "fitted portion positioner."

The projections do not have to be arranged on the wall surrounding the fitted hole 65. This allows the discharge unit 33 to be moved in the vertical direction Y and the lateral direction Z relative to the waste liquid container 50 even when the waste liquid container 50 is in the retained state.

In the above embodiment, the two ribs 69 restrict displacement of the device connection terminal 34 in the terminal groove 67 toward the outer side in the lateral direction Z. However, only one rib 69 of either the upper surface 672 or the lower surface 673 may be arranged. In this case, the single rib 69 restricts displacement of the device connection terminal 34 in the terminal groove 67 toward the outer side in the lateral direction Z.

The ribs 69 may be omitted as long as the device connection terminal 34 and the container connection terminal 68 can remain connected even when the device connection terminal 34 is displaced in the lateral direction Z in the terminal groove 67.

The distance H1 between the upper surface 672 and the lower surface 673 may be much greater than the length H2 of the terminal support 35, which supports the device connection terminal 34, in the vertical direction Y as long as the device connection terminal 34 and the container connection terminal 68 can remain connected even when the device connection terminal 34 is displaced in the terminal groove 67 in the vertical direction Y.

The fitted hole 65 may be located at any position between the two contacted surfaces 712 in the lateral direction Z as long as the discharge unit 33 can be fitted.

The fitted hole 65 may be located at any position in the vertical direction Y as long as the discharge unit 33 can be fitted and the fitted hole 65 is located at a higher position than the engaged portion 71. However, the layout of the fitted hole 65 at a higher position will increase the rotational force R.

When the removal restriction unit 36 is arranged on only one side of the retaining compartment 32 in the lateral direction Z, the engaged portion 71 of the waste liquid container 50 may include only one contacted surface 712. In this case, the removal restriction unit 36 may be arranged at the side of the retaining compartment 32 opposing the second side wall 56 of the waste liquid container 50. The restriction biasing member 362 of the removal restriction unit 36 pushes the container connection terminal 68 against the device connection terminal 34. This easily keeps the container connection terminal 68 connected to the device connection terminal 34.

Figure 18:
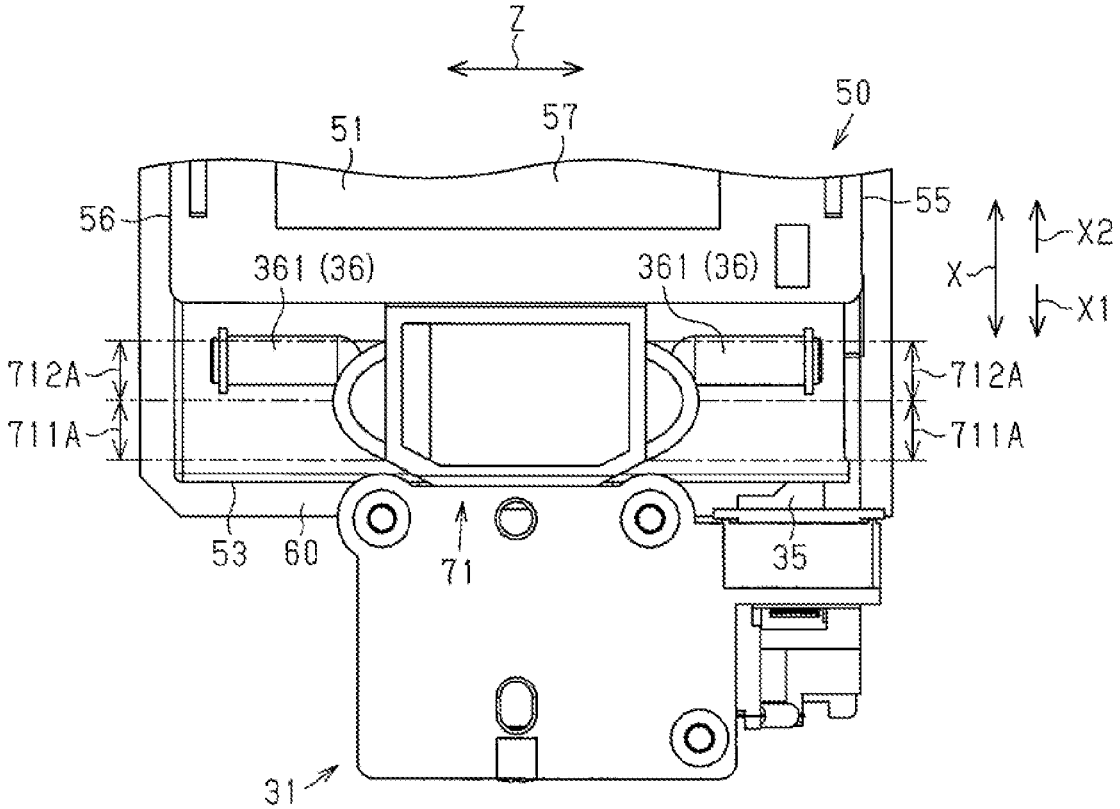
FIG. 18 is a plan view showing a portion of a waste liquid container in a further embodiment.

Contacted surface may have any structure other than that of the contacted surfaces 712 as long as the contacted surfaces are inclined toward the outer side in the lateral direction Z at positions closer to the front wall 53. For example, as shown in FIG. 18, the engaged portion 71 may include arcuate contacted surfaces 712A. In such a structure, the contacted surfaces 712A function as contacted portions.

Guide surface may have any structure other than that of the guide surfaces 711 as long as the guide surfaces are inclined toward the inner side in the lateral direction Z at positions closer to the front wall 53. For example, as shown in FIG. 18, the engaged portion 71 may include arcuate guide surfaces 711A. In such a structure, the guide surfaces 711A function as guides.

The engaged portion 71 may be configured so that the contacted surfaces 712 are located at the same position in the connection-disconnection direction X as the container connection terminals 68.

When the waste liquid container 50 is in the retained state, the basal end of the discharge unit 33 may be separated from the fitted hole 65 in the insertion direction X1. In this case, when in the retained state, the end of the terminal support 35 oriented in the removal direction X2 may contact the innermost end surface of the terminal groove 67 oriented in the removal direction X2 and connecting the bottom surface 671, the upper surface 672, and the lower surface 673. This restricts movement of the waste liquid container 50 in the insertion direction X1. In such a structure, the end of the terminal support 35 oriented in the removal direction X2 functions as one example of a "device contact portion of the device" and the innermost end surface functions as one example of an "insertion restriction portion."

The container connection terminal 68 may be arranged closer to the rear wall 54 than the front wall 53.

The liquid ejection device may be a device including a liquid ejection head that ejects a liquid other than ink such as a liquid formed by dispersing or mixing particles of a functional material in liquid. For example, the liquid ejection head may eject a liquid including a dispersed or dissolved material, such as an electrode material or a color material (pixel material), used to manufacture liquid crystal displays, electroluminescence (EL) displays, surface-emitting displays, and the like.

The waste liquid container may contain waste liquid produced by liquefying recovered mist that is scattered when liquid is ejected. Instead of liquid that is ejected toward a target, the waste liquid container may contain various types of functional liquids such as a cleaning liquid used to clean the liquid ejection head or the like.

The device that retains the waste liquid container 50 may be any device other than a liquid ejection device as long as it discharges used liquid from a discharge unit as waste liquid. Examples of such a device include a cleaning device that cleans a target with a liquid such as water and a testing device that conducts tests using a testing liquid.

The present examples and embodiments are to be considered as illustrative and not restrictive, and the invention is not to be limited to the details given herein, but may be modified within the scope and equivalence of the appended claims.

What is claimed is:

1. A waste liquid container that is coupled in a removable manner to a device that includes a retaining compartment and a discharge unit, which is located at an innermost part of the retaining compartment, wherein the waste liquid container is adapted to be inserted into the retaining compartment in a direction defined as an insertion direction, the waste liquid container is adapted to be removed from the retaining compartment in a direction that is opposite to the insertion direction and defined as a removal direction, and the insertion direction and a vertical direction both are transverse to a direction defined as a lateral direction, the waste liquid container comprising:

a collection compartment located inside the waste liquid container, wherein the discharge unit discharges waste liquid into the collection compartment when the waste liquid container is in a retained state inserted into the retaining compartment;

a front wall located at an innermost part of the retaining compartment in the retained state;

a fitted portion located in the front wall, wherein the discharge unit is fittable to and removable from the fitted portion;

a side wall that extends in the removal direction from the front wall in the retained state; and a container connection terminal located in the side wall, the container connection terminal being contactable with a connection terminal of the device;

wherein the side wall includes a terminal groove extending in the removal direction from a portion connected to the front wall, the container connection terminal is located in the terminal groove, the terminal groove is configured to receive the connection terminal of the device when the waste liquid container is inserted into the retaining compartment, and the container connection terminal is configured to contact the connection terminal of the device in the retained state.

2. The waste liquid container according to claim 1, wherein the retaining compartment is in communication with the outside through a retaining port in a housing of the device, the waste liquid container includes a rear wall located toward the retaining port in the retained state, and the container connection terminal is located closer to the front wall than the rear wall.

3. The waste liquid container according to claim 1, wherein the waste liquid container further comprises a connection terminal positioner configured to position the connection terminal of the device in the vertical direction relative to the container connection terminal in the terminal groove.

4. The waste liquid container according to claim 1, further comprising a separation restriction unit configured to restrict separation of the connection terminal of the device from the container connection terminal in the lateral direction when in the retained state.

5. The waste liquid container according to claim 1, further comprising:

an opening that communicates the collection compartment with the outside; and a cover that covers the opening.

6. A liquid ejection device comprising:

the waste liquid container according to claim 1;

a liquid ejection head that ejects liquid;

a retaining compartment into which the waste liquid container is inserted so that the waste liquid container is retained in a removable manner; and a discharge unit that discharges waste liquid into the collection compartment of the waste liquid container that is inserted into the retaining compartment.

7. A waste liquid collection system comprising:

a waste liquid container retaining unit including a retaining compartment; and a waste liquid container adapted to be inserted into and retained in the retaining compartment in a removable manner, wherein the waste liquid container is adapted to be inserted into the retaining compartment in a direction defined as an insertion direction, the waste liquid container is removed from the retaining compartment in a direction that is opposite to the insertion direction and defined as a removal direction, and the insertion direction and a vertical direction both are transverse to a direction defined as a lateral direction;

the waste liquid container retaining unit includes a discharge unit that discharges waste liquid, wherein the discharge unit is located at an innermost part of the retaining compartment, a device discharge unit member that biases the discharge unit in the removal direction, and a device connection terminal located at a position lower than the discharge unit;

the waste liquid container includes a front wall located at an innermost part of the retaining compartment in the retained state, a fitted portion located in the front wall, wherein the discharge unit is fitted into the fitted portion, a side wall extending in the removal direction from the front wall in the retained state, and a container connection terminal that contacts the device connection terminal, the container connection terminal being located in the side wall, wherein the side wall includes a terminal groove extending in the removal direction from a portion connected to the front wall, the container connection terminal is located in the terminal groove, the terminal groove is configured to receive the connection terminal of the device when the waste liquid container is inserted into the retaining compartment, and the container connection terminal is configured to contact the connection terminal of the device in the retained state.

* * * * *